US007866645B2

(12) United States Patent
Fujita et al.

(10) Patent No.: US 7,866,645 B2
(45) Date of Patent: Jan. 11, 2011

(54) BOOKBINDING APPARATUS AND IMAGE FORMING APPARATUS

(75) Inventors: Keiko Fujita, Kashiwa (JP); Kiyoshi Watanabe, Matsudo (JP); Hajime Sekiguchi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 610 days.

(21) Appl. No.: 11/870,142

(22) Filed: Oct. 10, 2007

(65) Prior Publication Data

US 2008/0101890 A1 May 1, 2008

(30) Foreign Application Priority Data

Oct. 26, 2006 (JP) ..... 2006-291646

(51) Int. Cl.

| | |
|---|---|
| ***B65H 5/30*** | (2006.01) |
| ***B65H 39/00*** | (2006.01) |
| ***B65H 33/04*** | (2006.01) |
| ***B65H 41/00*** | (2006.01) |

(52) U.S. Cl. ..... 270/37; 270/58.07; 270/58.08; 270/52.18; 270/52.26; 270/52.3; 412/14

(58) Field of Classification Search ..... None
See application file for complete search history.

(56) References Cited

U.S. PATENT DOCUMENTS

| | | | | |
|---|---|---|---|---|
| 3,659,772 | A * | 5/1972 | Dorsey et al. | 229/5.85 |
| 7,503,554 | B2 * | 3/2009 | Trovinger et al. | 270/52.26 |

FOREIGN PATENT DOCUMENTS

| | | | |
|---|---|---|---|
| JP | 61-2671 | | 1/1986 |
| JP | 5-278197 | | 10/1993 |
| JP | 11-157247 | | 6/1999 |
| JP | 11157247 | A * | 6/1999 |

* cited by examiner

*Primary Examiner*—Gene Crawford
*Assistant Examiner*—Yolanda Cumbess
(74) *Attorney, Agent, or Firm*—Fitzpatrick, Cella, Harper & Scinto

(57) ABSTRACT

A bookbinding apparatus comprises, a stacking unit on which sheets are stacked; a folding portion which folds the sheets stacked on the stacking unit; a humidifying unit which humidifies portions of the sheets to be fold lines of a booklet before folding by the folding portion; and a controller which controls a humidifying condition at the time of the humidifying by the humidifying unit, wherein the humidifying condition is variable according to the sheets composing the booklet.

21 Claims, 18 Drawing Sheets

BOOKBINDING APPARATUS AND IMAGE FORMING APPARATUS

BACKGROUND OF THE INVENTION

1. Field of the Invention

The present invention relates to a binding device for forming a fold line on a booklet and an image forming apparatus having this.

2. Description of the Related Art

Conventionally, a binding device for folding a sheet outputted from a main body of an image forming apparatus such as a copying machine and a printer in half and sewing the inside of a book has been known.

The constitution of such a binding device is disclosed in Japanese Patent Application Laid-Open No. 61-2671. In addition, FIG. 16 shows a schematic block diagram of a main body of a conventional image forming apparatus 10 and a binding device 11 on their cross sections, which are disclosed in JP-A No. 61-2671.

As shown in FIG. 16, the binding device 11 is provided with a stack tray 12 as a sheet stacking portion, a folding knife 15 as a folding portion, and a folding roller pair 16 as a fold line forming portion.

On the stack tray 12, an opening portion 14 is disposed on its center portion, and a stopper 13 for stopping the sheet on a fixed position is disposed on an end portion of the stack tray 12. In addition, on the upper part of the opening portion 14 of the stack tray 12, the folding knife 15 is disposed so as to be capable of rising and falling.

When the sheets are conveyed from the main body of the image forming apparatus 10 to the binding device 11, the conveyed sheets material are stacked on the stack tray 12 in series.

Then, the folding knife 15 that is disposed upward of the stack tray 12 falls on the sheets stacked on the stack tray 12, and the folding knife 15 strikes the center portion of the sheet so as to fold the sheet and push the sheet into the opening portion 14 of the stack tray 12. In the following explanations, a plurality of sheets stacked on the stack tray 12 being folded down calls a booklet.

Sheets pushed into the opening portion 14 of the stack tray 12 is folded down to be made into a booklet. After that, the booklet is provided to the folding roller pairs 16 being folded down. The folding roller pairs 16 forms a fold line on the center portion of the booklet by conveying the booklet provided while sandwiching it from the opposite sides. The booklet having the fold line formed thereon is conveyed on a tray 17 due to rotation of the folding roller pairs 16 to be stacked on the tray 17.

However, when a pressure applied by the folding roller pair 16 is released, the booklet is opened by its own elasticity and a fold line of the booklet formed by the conventional bookbinding apparatus 11 is occasionally returned to the original state. As a result, the booklet has a poor-looking appearance such that the fold line is opened.

The problem relating to the opening of the fold line is most obvious in the case where sheets whose opening amount is large are used as sheets composing a booklet. The sheets whose opening amount is large mean sheets which are once folded but are easily opened including sheets such as cardboard whose rigidity is high and sheets such as thin paper whose rigidity is low but whose periphery has a small water amount in a low-humidity environment.

When a fold line is formed by bending sheets whose opening amount is originally small to a direction orthogonal to a fiber orientation of the sheets, the sheets are easily opened greatly. Such sheets are, therefore, regarded as sheets whose opening amount is large.

The problem relating to the opening of the sheet is not eliminated to not less than a certain degree even by increasing a pressure to be applied by the folding roller pair 16. For this reason, solving means other than the method for increasing the pressure by the folding roller pair 16 is required. As one example of the solving means, Japanese Patent Application Laid-Open No. 11-157247 discloses a method for humidifying sheets using a humidifying unit so as to ease the forming of fold lines of the sheets.

FIG. 17 is a schematic block diagram on a cross section of the binding device 11 having humidifying unit disclosed in JP-A No. 11-157247.

The bookbinding device 11 shown in FIG. 17 is provided with a humidifying chamber 18 as a humidifying unit, humidifying nozzles 19 and 20, and a heating roller pair 30 as a heating portion.

In FIG. 17, the humidifying chamber 18 humidifies sheets which are being conveyed on an upper stream side of the stack tray 12. The humidifying nozzle 19 humidifies a part of a booklet to be folded on an upper stream side of the folding roller pair 16. The humidifying nozzle 20 humidifies a part of a booklet to be folded on a lower stream side of the folding roller pair 16.

When these humidifying units 18, 19, and 20 humidify a part of a booklet to be folded, even if sheets whose opening amount is large are used, before a fold line is formed by the folding roller pair 16, the opening amount of the sheets can be reduced. Therefore, a fold line can be easily formed by the folding roller pair 16, so that a good-looking booklet without opening can be provided.

In the bookbinding apparatus 11 having the humidifying units disclosed in Japanese Patent Application Laid-Open No. 11-157247, however, a humidifying condition is not changed according to sheets in which a fold line is formed. For this reason, in the case of a booklet made of particularly sheets which water hardly penetrates such as sheets whose surface is specially treated, the sheets are curled to a direction where the booklet opens, and thus the booklet might have a poor-looking appearance.

In the conventional humidifying units, since the humidifying chamber 18 is constituted so as to humidify also a portion of a sheet which is not folded, this unnecessary humidifying causes inefficiency of the device.

As shown in FIG. 17, since the humidifying nozzles 19 and 20 humidify only a sheet on an outmost position of a booklet in the sheets composing the booklet, it is difficult to humidify sheets on an inner position of the booklet.

As a result, the opening amount of the sheets on the inner position with respect to the sheet on the outer position of the booklet cannot be sufficiently reduced, and thus the booklet might have a poor-looking appearance where the opening occurs.

In addition, the portion of the sheet that is humidified by the humidifying nozzle 19 is exposed from an opening portion 14 of the stack tray 12 to the outside. Therefore, water given by the humidifying nozzle 19 evaporates around the area till the booklet is folded down on the inside by the folding roller pairs 16.

As a result, since the opening amount of the sheet cannot be sufficiently reduced, the booklet might have a poor-looking appearance where opening occurs.

A phenomenon from the humidifying of the sheets to the occurrence of a curl is described with reference to FIGS. 18A, 18B, and 18C.

FIGS. 18A, 18B, and 18C are pattern diagrams showing a cross section of humidified sheets. In the drawings, a portion humidified by the humidifying units (hatched portion in the drawings) once stretches just after humidifying, but when the sheets are again dried, forces to a direction where the sheets further shrink with respect to the shape before humidifying are generated as shown by arrows in the drawings.

On the other hand, a portion which is not humidified is hardly influenced by humidifying and drying, and thus it does not stretch nor shrink. Therefore, a shrinkage amount is different between the portion to be humidified and the portion which is not humidified. As a result, when the sheets are humidified, the sheets are easily curled to a direction where the humidified surfaces of the sheets shrink.

That is, as shown in FIG. 18C, in the case where the inner side of the booklet shrinks due to the humidifying of the inner side, the sheets are curled to a direction where the booklet is closed. As a result, the sheets do not open, and the booklet does not have a poor-looking appearance.

As shown in FIG. 18A, however, since the humidifying nozzles 19 and 20 humidify the outer side of the booklet, the outer side of the booklet shrinks. Therefore, the sheets are curled to the direction where the booklet is opened, the opening occurs, and the booklet might have a poor-looking appearance.

SUMMARY OF THE INVENTION

It is an object of the present invention to provide a bookbinding apparatus which effectively humidifies sheets so as to bind a good-looking booklet without opening, and an image forming apparatus having the bookbinding apparatus.

In order to attain the above object, the present invention includes: a stacking unit on which a sheets are is stacked; a folding portion which folds the sheets stacked on the stacking unit; a humidifying unit which humidifies a portion of the sheet that is made into a fold line of a booklet before folding by the folding portion; and a controller which controls a humidifying condition at the time of the humidifying by the humidifying unit. The humidifying condition is variable according to each sheet composing the booklet.

An image forming apparatus of the present invention includes the above bookbinding apparatus and an image forming unit which forms an image on sheets.

According to the present invention, the humidifying unit is provided with the controller which controls the humidifying condition, so that the portions to be fold lines of the booklet are humidified. As a result, the bookbinding apparatus which can bind a good-looking booklet without opening and the image forming apparatus having he bookbinding apparatus can be provided.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Embodiments of the present invention are described below with reference to the drawings. Like members are denoted by like reference numbers in all the drawings in the following embodiments. Dimensions, materials, shapes, and relative positions of the components described in the embodiments should be suitably changed according to constitutions of apparatuses to which the present invention is applied and various conditions, and the scope of the present invention is not limited to the following embodiments.

First Embodiment

With reference to FIG. 1, FIG. 2, FIG. 4A, FIG. 4B, FIG. 7A, FIG. 7B, FIG. 8A, FIG. 8B, FIG. 9A, FIG. 9B, a bookbinding device and an image forming apparatus having this according to a first embodiment of the present invention will be described.

Figure 1:
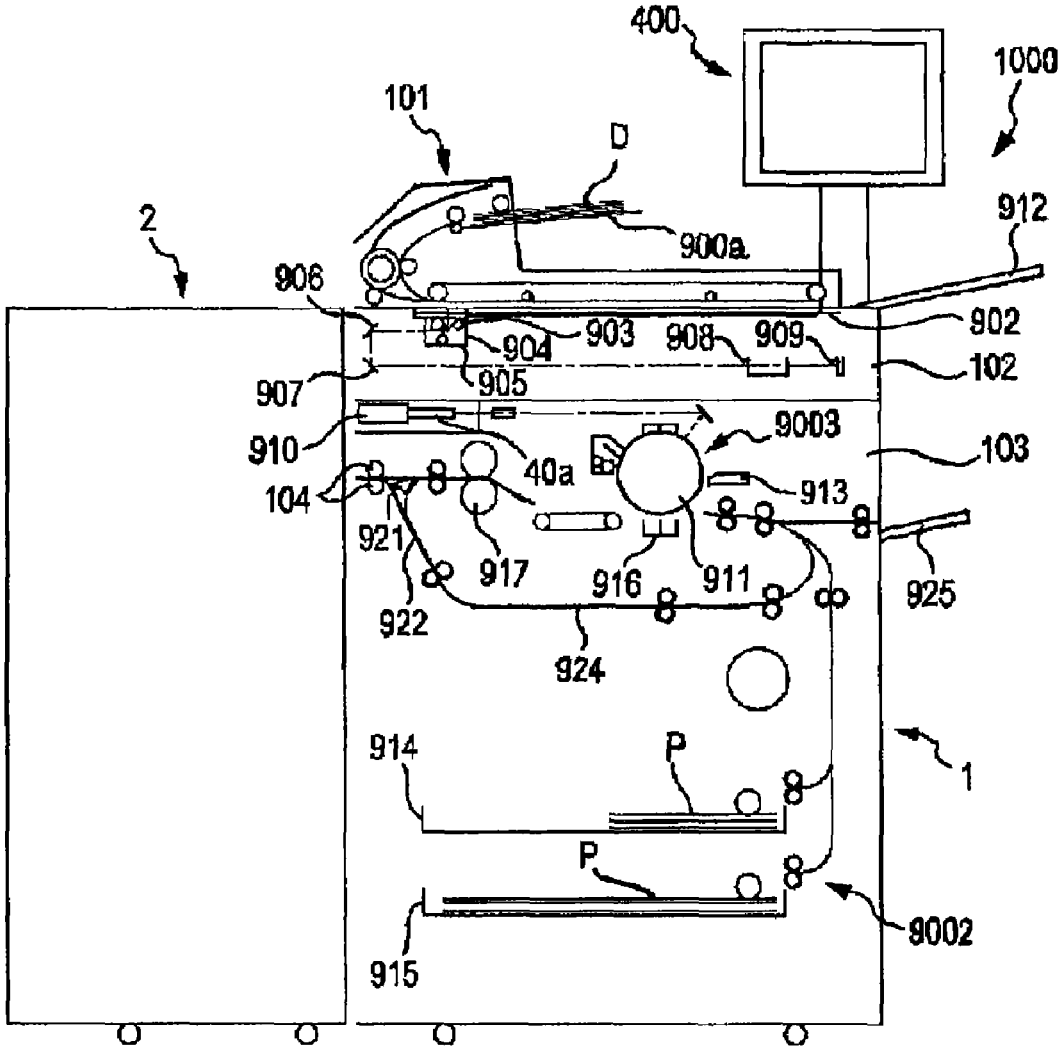
FIG. 1 is a schematic block diagram of an image forming apparatus according to a first embodiment of the present invention.
Figure 2:
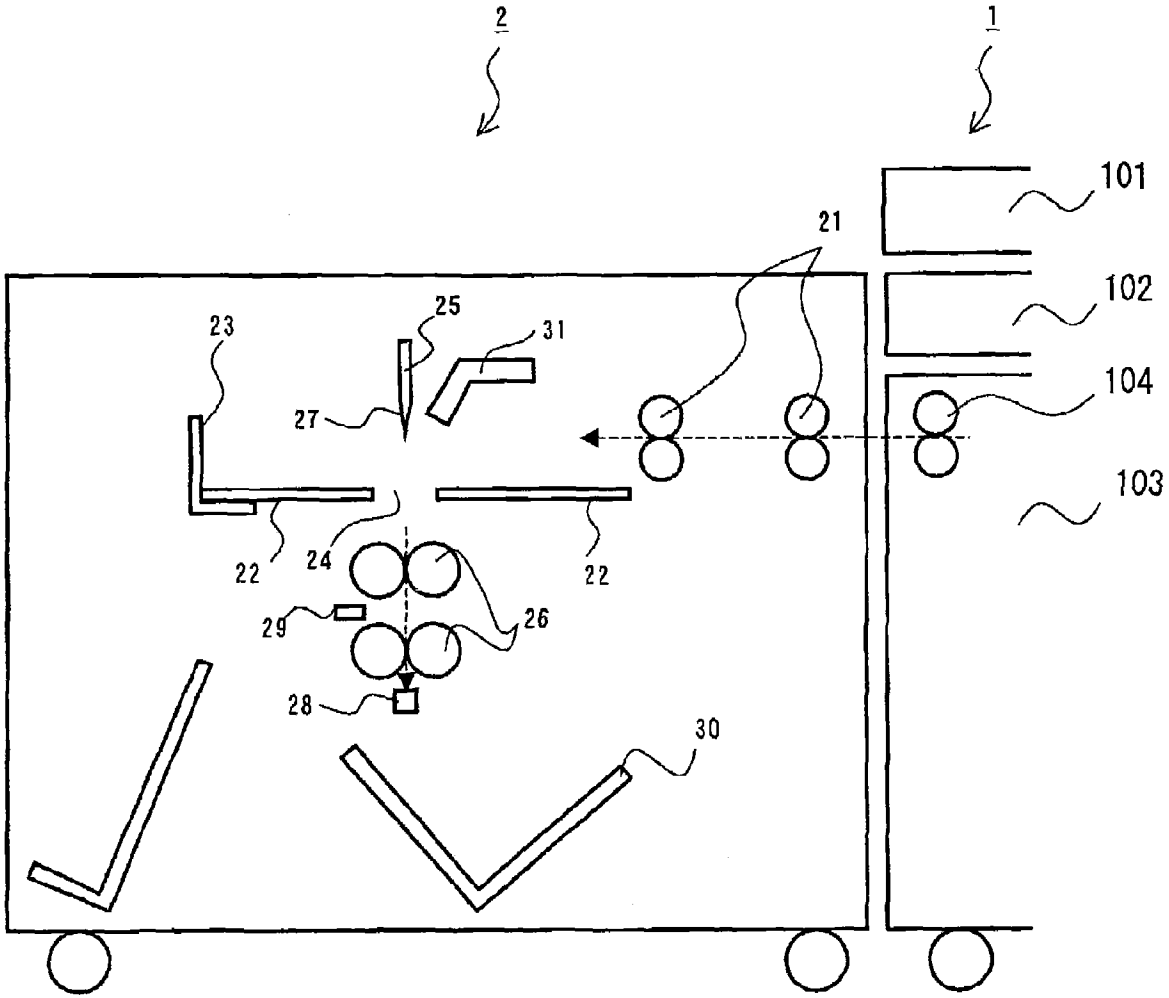
FIG. 2 is a schematic block diagram of a bookbinding device according to the first embodiment of the present invention.

FIG. 1 is a schematic block diagram of a main body of an image forming apparatus 1 on its cross section, and FIG. 2 is a schematic block diagram of a binding device 2 on its cross section.

(Construction of the Image Forming Apparatus Main Body)

As shown in FIG. 1, an image forming apparatus 1000 is provided with an image forming portion 9003 that is disposed in the inside of the main body of the image forming apparatus 1 and a binding device 2. As an image forming apparatus that is structured in this way, for example, a digital copying machine or the like is considered. Below, the construction and operation of the main body of the image forming apparatus 1 that is having the image forming portion 9003 therein will be described.

In addition, the main body of the image forming apparatus 1 is provided with a printer portion 103, a scanner 102 that is arranged on the upper face of the printer portion 103, and a document feeding device 101 for feeding a document to the scanner 102.

Further, the scanner 102 for reading an image of the document is provided with a scanner unit 904, mirrors 905 to 907, a lens 908, and an image sensor 909 or the like.

Then, upon reading of a document D by this scanner 102, at first, the document D is set on a document tray 900*a* of the document feeding device 101. In this case, it is assumed that the document D is set in a face-up condition, namely, with the face on which an image is formed on the document tray 900*a* is on the up.

Next, after conveying the document D one by one from a head page in series by the document feeding device 101, the document D is conveyed on a platen glass 902 via a curved path from a left direction into a right direction to be discharged on a discharge tray 912.

When an image of an original in conveyance is read by the document conveying apparatus 101, the scanner unit 904 is held in a predetermined position, and when the original D passes along the scanner unit 904 from left to right so that a reading process is executed on the original D.

In the reading process, when the original D passes through the platen glass 902, the lamp 903 of the scanner unit 904 irradiates the original D, and its reflected light reaches the image sensor 909 via the mirrors 905 to 907 and the lens 908.

The image data of the original read per line by the image sensor 909 is sent to an exposing device 910.

In addition, stopping the document D to be conveyed by the document feeding device 101 on the platen glass 902 once, it is possible to carry out reading process of the document by moving the scanner unit 904 from left to right in this state.

Further, in the case of reading the document without using the document feeding device 101, a user may lift the document feeding device 101 and set the document on the platen glass 902. After that, the user may carry out the reading process of the document.

In addition, the main body of the image forming apparatus 1 is provided with a sheet feeding portion 9002 for feeding a sheet P housed in cassettes 914 and 915 and an image forming portion 9003 for transferring an image on the sheet P that is fed by the sheet feeding portion 9002 other than the above-described devices.

Here, the image forming portion 9003 is provided with a photosensitive drum 911, a development unit 913, and a transfer charger 916 or the like, and upon forming of the image, by irradiating a laser light from the exposure apparatus 910 on the photosensitive drum 911, an electrostatic latent image is formed on the photosensitive drum 911.

Then, this electrostatic latent image is imaged as a toner image by the development unit 913. Further, on the downstream side in a conveying direction of the image forming portion 9003, a fixing unit 917 and a discharge roller pair 104 or the like are arranged.

On the upper face of the main body of the image forming apparatus 1, an operation display unit 400 is disposed, and the operation display unit 400 has a plurality of keys for setting various functions for formation of an image and a display unit for displaying the information showing the setting state or the like.

Next, the image forming operation of the main body of the image forming apparatus 1 that is constituted as described above will be described.

At first, as already described, after predetermined imaging process is carried out, the image data of the document D that is read by the image sensor 909 of the scanner 102 is sent to the exposure apparatus 910. After that, the exposure apparatus 910 may output a laser light in response to this image signal.

Then, this laser light is irradiated on the photosensitive drum 911 while being scanned by a polygon mirror. Thereby, on the photosensitive drum 911, an electrostatic latent image in response to the scanned laser light is formed.

Next, the electrostatic latent image formed on the photosensitive drum 911 is developed by the development unit 913 so that the electrostatic latent image is visualized as a toner image.

On the other hand, the sheet P is conveyed from any among the cassettes 914 and 915, a manual sheet feed portion 925, and a double-sided conveyance path 924 to the image forming portion 9003, and on the image forming portion 9003, the visualized toner image on the photosensitive drum 911 is transferred on the sheet P. Then, the transferred sheet P is applied with fixing process by the fixing unit 917.

The sheet P having the image fixed thereon is discharged to a finisher 2 as a binding device by a discharge roller 104.

For example, in the case of discharging the sheet P from the main body of the image forming apparatus 1 with the face on which the toner image is formed being turned downward (namely, face down), the sheet P passed through the fixing unit 917 is guided to a path 922 by a flapper 921.

Then, going through the flapper 921, the rear end of the sheet P is switched-backed. Then, the sheet P is conveyed to the discharge roller 104 again by the flapper 921 to be discharged from the main body of the image forming apparatus 1.

Thereby, the sheet P is discharged from the main body of the image forming apparatus 1 with the face where the toner image is formed being in up. By discharging the sheet P in a face-up condition by such inverted discharge, it is possible to align the page order in the case of carrying out the image forming process in series from a head page of the booklet, namely, in the case of carrying out the image forming process, for example, by using the document feeding device 101.

In addition, also in the case of carrying out the image forming process for the image data from a computer, it is possible to align the page order.

In addition, in the case of carrying out the image forming process while conveying a hard sheet P such as an OHP sheet from the manual sheet feed portion 925 not to guide the sheet P to the path 922. The sheet P may be discharged from the main body of the image forming apparatus 1 by the discharge roller 104 with the face where the toner image is formed being in a face-up condition.

Further, in the case of carrying out the image forming process on the opposite sides of the sheet P, the sheet P is guided from the fixing unit 917 straight in a direction of the discharge roller 104.

Then, the sheet P is switch-backed just after the rear end of the sheet P goes through the flapper 921 so as to be guided to the double-sided conveyance path 924 from the path 922 by the flapper 921.

Figure 3:
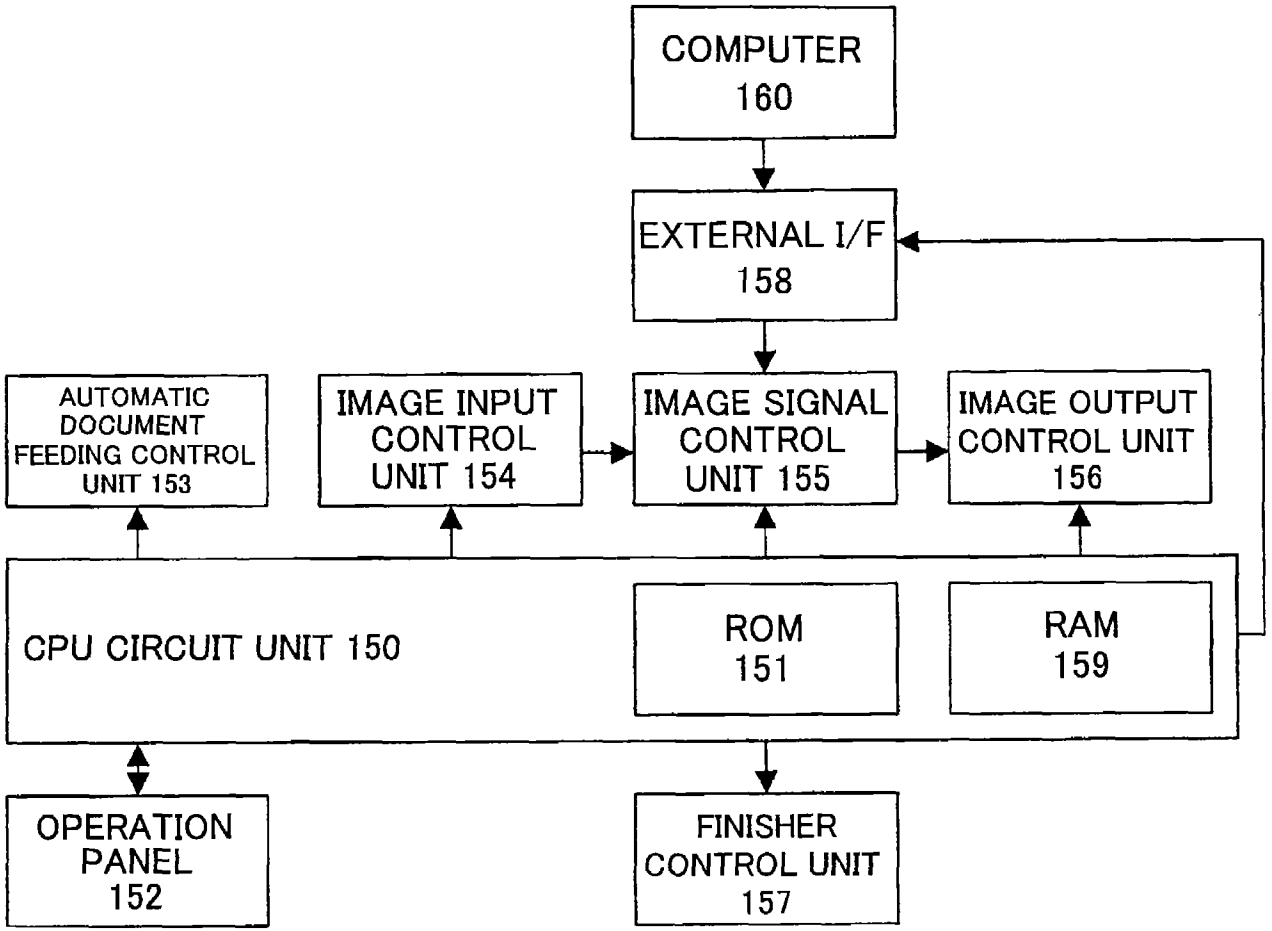
FIG. 3 is a block diagram of control construction according to the first embodiment of the present invention.

Next, with reference to FIG. 3, a controller of the image forming apparatus 1000 according to the first embodiment will be described. FIG. 3 is a block diagram showing the controller of the image forming apparatus 1000.

As shown in FIG. 3, the controller of the image forming apparatus 1000 is configured by an automatic document feed control portion 153, an image input control unit 154, an image signal control unit 155, an image output control unit 156, a finisher control unit 157, and an external I/F 158. Then, a CPU circuit unit 150 as the control device in the main body of the image forming apparatus 1 may control these respective control units in accordance with a control program stored in a ROM 151 and setting of an operation unit 152.

Then, the automatic document feed control portion 153 controls the document feeding device 101, the image input control unit 154 controls the scanner 102, the image output control unit 156 controls the exposure apparatus 910, and the finisher control unit 157 controls the binding device (finisher) 2. In addition, the operation unit 152 has a plurality of keys for setting various functions for formation of the image and the display unit for displaying the setting condition or the like. This operation unit 152 outputs a key signal in response to the operation of each key by the user to the CPU circuit unit 150 and displays the information on the display unit on the basis of the signal outputted from the CPU circuit unit 150.

A RAM 159 is used as an area for temporarily holding the control data and an operational area of calculation in accordance with control. The external I/F 158 is an interface with the image forming apparatus 1000 and an external computer 160 and the external I/F 158 extracts the print data from the computer 160 into a bit map image and outputs it to the image signal control unit 155 as the image data.

In addition, the image of the document that is read by an image sensor (not shown) from the image input control unit 154 to the image signal control unit 155. The image output control unit 156 outputs the image data from the image signal control unit 155 to an exposure control unit (not shown).

(Constitution of the Bookbinding Device)

Next, with reference to FIG. 2, the constitution of the binding device 2 according to the first embodiment will be described.

In FIG. 2, the sheet outputted from the main body of the image forming apparatus 1 is conveyed into the binding device 2 one by one by a conveying roller pair 21 to be stacked on a stack tray 22 as a stacking portion. On the stack tray 22, a stopper 23 is movably arranged on an edge on a downstream side in a sheet conveying direction.

The stopper 23 is positioned in response to the size of the sheet to be used so that a center portion of the sheet to be stacked on the stack tray 22 coincides with the center portion of an opening portion 24 that is formed on the stack tray 22.

Every time each sheet is fed on the stack tray 22, a front end of the sheet hits the stopper 23 by a pulling-over skid (not shown) for each sheet and matching of a conveying direction and an orthogonal direction is carried out by a jogging plate (not shown).

When all sheets to configure the booklet are stacked on the stack tray 22, a folding knife 25 arranged on the upper part of the opening portion 24 as the folding portion may fall. Then, the folding knife 25 further falls through the opening portion 24 while hitting the center portion of the sheet stacked on the stack tray 22 so as to push the sheet downward from the opening portion 24 while folding the center portion of the sheets.

The sheet is folded by the folding knife 25 so that the sheet pushed downward of the stack tray 22 from the opening portion 24 is conveyed as a booklet to the folding roller pairs 26 as a fold line forming portion with the folding knife 25. Then, the sheet is sandwiched from the opposite sides by the folding roller pairs 26. In this case, the booklet is formed a fold line. Further, the present embodiment may be constituted so that a spring (not shown) is connected to the folding roller pairs 26 and the thickness of the booklet may be absorbed.

On the other hand, on the bottom end edge portion of the folding knife 25 hitting the center portion of the sheet, a stapler 27 for binding the booklet by a stopper (a needle of the stapler) is disposed. Further, down below the folding roller pairs 26, a strike plate 28 of the stapler that can move for the sheet conveying path is disposed.

Therefore, the bookbinding device 2 according to the first embodiment is configured so as to be capable of carrying out the saddle stitching by the stapler 27 and the strike plate 28 while being formed a fold line for the booklet by the folding roller pairs 26.

After forming a fold line and the saddle stitching for booklet are carried out, the folding knife 25 leaves from a nip position of the folding roller pairs 26 while rising. Then, by further rotating the folding roller pairs 26, the booklet having the fold line formed is conveyed in a direction of a tray 30.

Further, in the binding device 2 shown in FIG. 2, the stack tray 22 is described as a constitution that is horizontally arranged. However, the constitution of the binding device 2 according to the first embodiment is not limited to this and if the binding device 2 is configured at an angle in the range of 0° to 85° for a horizontal face, the sheet can be stacked on the stack tray 22.

In addition, the stapler 27 is described as the constitution that is integrally disposed on the front end portion of the folding knife 25, however, the constitution of the binding device 2 according to the first embodiment is not limited to this. For example, the stapler 27 as a different body from the folding knife 25 may be disposed on the upstream side of the folding knife 25 together with the strike plate 28.

According to this constitution, due to the operation of the stopper 23 and the pulling-over skid (not shown), two stopping positions of the sheet on the stack tray 22 are provided, and the saddle stitching process is carried out on the stack tray 22 in first, so that the forming a fold line for the booklet can be carried out.

In addition, these controls for the sheet processing are carried out from the CPU circuit unit 150 on the side of the main body of the image forming apparatus 1 via the finisher control unit 157 on the side of the binding device 2 on the basis of setting of various process modes that are inputted from the operation unit 152 or the external computer 160.

In addition, disposing the finisher control unit 157 so as to be integrated with the CPU circuit unit 150 on the side of the main body of the image forming apparatus 1, the sheet processing may be controlled directly from the main body of the image forming apparatus 1.

(Constitution of the Humidifying Unit)

Next, with reference to FIG. 4A and FIG. 4B, the constitution of the humidifying portion according to the first embodiment of the present invention will be described.

Figure 4A:
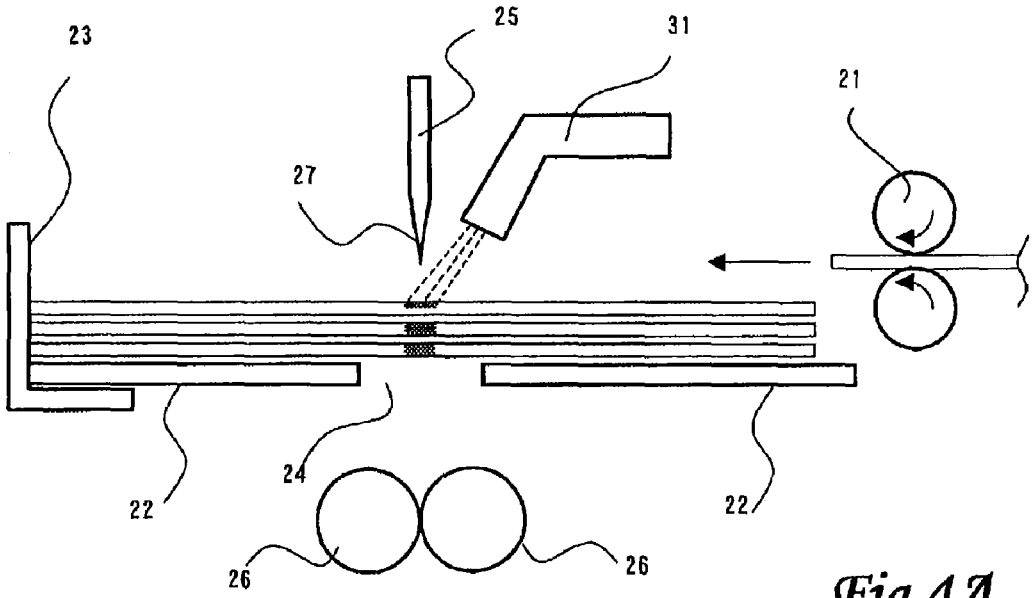
FIG. 4A is a pattern diagram for showing humidifying control of sheet according to the first embodiment of the present invention.
Figure 4B:
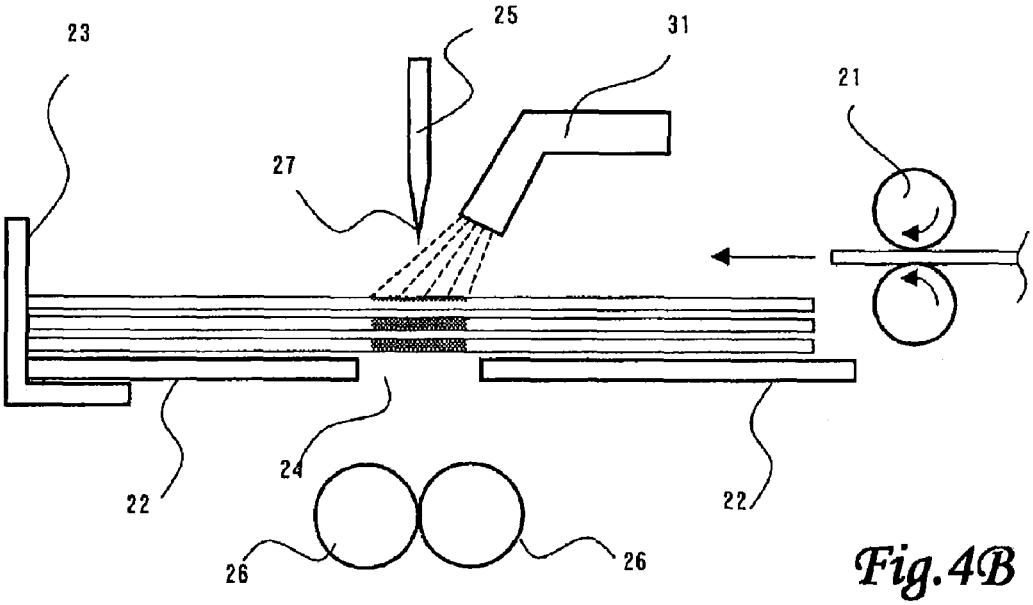
FIG. 4B is a pattern diagram for showing humidifying control of sheet according to the first embodiment of the present invention.

As shown in FIG. 4A and FIG. 4B, on the bookbinding device 2 according to the first embodiment, a humidifying nozzle 31 as the humidifying portion is arranged on the upper part of the opening portion 24 of the stack tray 22.

The humidifying nozzle 31 may humidify the portion to form the fold line of the booklet of the sheet that is conveyed on the stack tray 22. When the sheet is humidified, the rigidity of the sheet can be lowered. When the rigidity of the sheet is lowered it can be formed a fold line for the booklet more certainly, it is possible to obtain the booklet having a small opening and a good appearance.

That is, according to the above constitution, the rigidity of a part which is the fold line of the booklet of the sheet can be lowered, so that a folding effect due to the folding roller pairs 26 is increased and it is possible to obtain the sheet having a small opening and a good appearance. In addition, this constitution is efficient because humidification is not made on a portion that there is no need for folding and humidification can be made only on a necessary portion.

In addition, the humidifying nozzle 31 according to the first embodiment of the present invention is constituted so as to humidify the stacked sheets stacked on the stack tray 22 from the side that becomes the inside of the booklet.

When sheets are humidified as mentioned above, water is dried after humidifying so that the humidified side shrinks. The sheets are then curled to the humidified side.

Figure 18A:
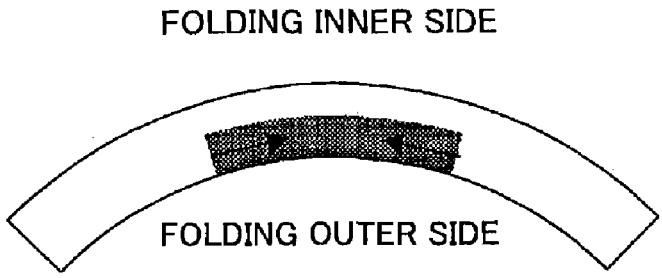
FIG. 18A is a pattern diagrams for showing generation of curling of a sheet.

As shown in FIG. 18A, when the sheets are humidified from the outer side of the booklet, the sheets are curled to the booklet opening direction, and opening occurs, thereby providing the poor-looking booklet.

Figure 18B:
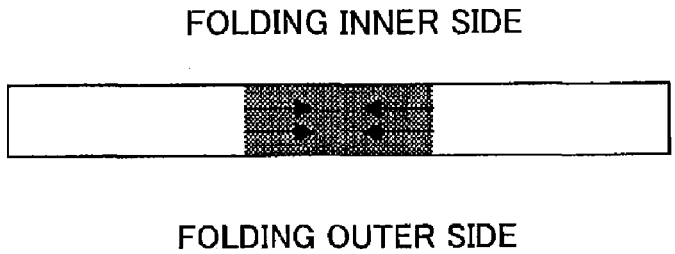
FIG. 18B is a pattern diagrams for showing generation of curling of a sheet.

As shown in FIG. 18B, when the sheets are humidified so that water uniformly gets across its thickness-wise direction, the sheets are not curled. It, however, takes time that water uniformly gets across the thickness-wise direction, thereby reducing the production efficiency of the booklet.

Figure 18C:
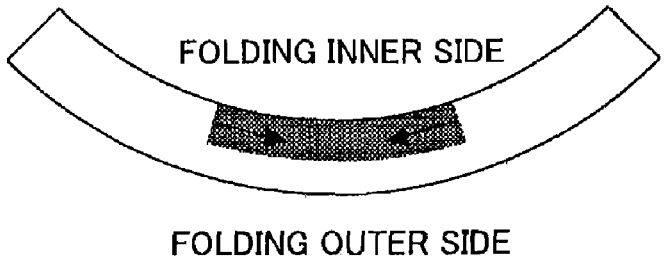
FIG. 18C is a pattern diagrams for showing generation of curling of a sheet.

In the first embodiment, however, as shown in FIG. 18C, since the humidifying is started on the inner side of the booklet, the sheet on the inner side of the booklet shrinks, and thus the sheets are curled to a direction where the booklet is closed. That is to say, in the first embodiment, even if the sheets are curled, they are not curled to the direction where the booklet is opened. As a result, the good-looking booklet can be provided.

In addition, the humidifying nozzle 31 of the binding device 2 according to the first embodiment of the present invention is structured so as to humidify the booklet from the upper part of the stack tray 22. According to the above constitution, it is possible to humidify the sheet to be stacked on the stack tray 22 one by one.

Therefore, since the fold lines of all the sheets composing the booklet can be humidified, the opening amount of the booklet can be sufficiently reduced without nonuniform humidifying in the booklet.

Further, as the humidifying nozzle 31 according to the first embodiment of the present invention, one for injecting a liquid drop by a piezoelectric device and one for injecting a liquid drip by air bubbles generated due to heat, which are used for a head of an inkjet printer, can be applied.

In addition, the fixed humidifying nozzle 31 may be disposed across the entire area where the fold line is formed or the fixed humidifying nozzle 31 may be disposed, which scans the portion where the fold line is formed in a direction along an inner-folded line.

In addition, the humidifying unit according to the first embodiment of the present invention is not limited to the humidifying nozzle 31 but it is obvious that the same advantage can be obtained even by the constitution to apply water by a roller and a brush or the like.

In addition, a volatile component such as water and ethanol and a transparent ink for an inkjet printer or the like may be available as a humidifying solution.

The humidifying solution is not limited to room-temperature one, and heating water vapor may be used. In this case, since the opening amount of the sheets can be further reduced by heat and moisture, the fold line can be formed securely on the sheets, and thus a good-looking booklet with less opening can be provided.

(The Constitution of the Stacking Unit)

Sheets are sequentially stacked on the stacking unit in the first embodiment so that their humidified surfaces face up. Since a humidified portion of the stacked sheet is covered with a sheet to be stacked thereon, the humidified portions of the sheets are not exposed to surroundings.

Therefore, while the folding roller pair 26 forms a fold line on the booklet, the moisture supplied to the sheets can be prevented from evaporating, thereby keeping the humidifying state satisfactory.

(Description of Humidifying Control)

The humidifying control in the first embodiment is described below with reference to FIGS. 4A, 4B, 7A, 7B, 8A, 8B, 9A, and 9B. The humidifying control is made by communication between the CPU circuit unit 150 of the image forming apparatus main body 1 and the finisher control unit 157 of the bookbinding apparatus 2.

In the first embodiment of the present invention, a controller is disposed. When the humidifying nozzle 31 as the humidifying unit humidifies portions of the sheets to be fold lines of a booklet, the controller controls a humidifying width variably. The humidifying width means a dimension in a direction perpendicular to the fold lines of a humidifying region formed along the fold lines of the sheets.

When sheets without less opening amount are humidified, portions to be fold lines of the booklet are humidified with the humidifying width shown in FIG. 4A, thereby sufficiently reducing the opening amount of the sheets.

However, when sheets with large opening amount are humidified, it is necessary for sufficiently reducing the opening amount of the sheets to increase the humidifying width and humidify the portions to be the fold lines of the booklet as shown in FIG. 4B.

As the opening amount of the sheets is larger, the humidifying width is controlled to become larger. As a result, even when sheets with large opening amount are used, the fold lines are formed securely on the sheets, so that the good-looking booklet without opening can be bound.

Figure 7A:
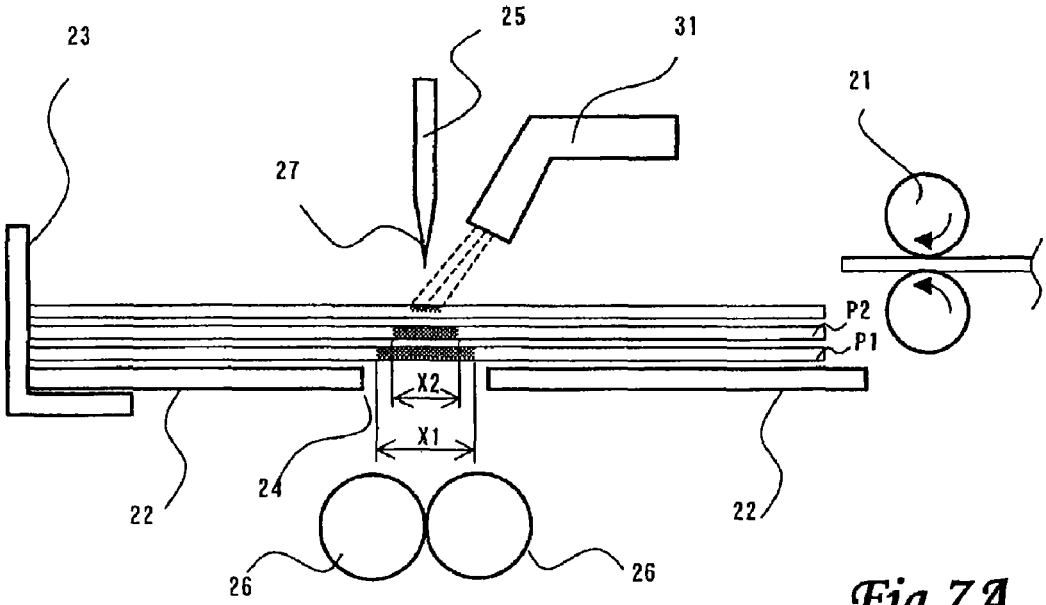
FIG. 7A is a pattern diagram for showing humidifying control of sheet according to the first embodiment of the present invention.
Figure 7B:
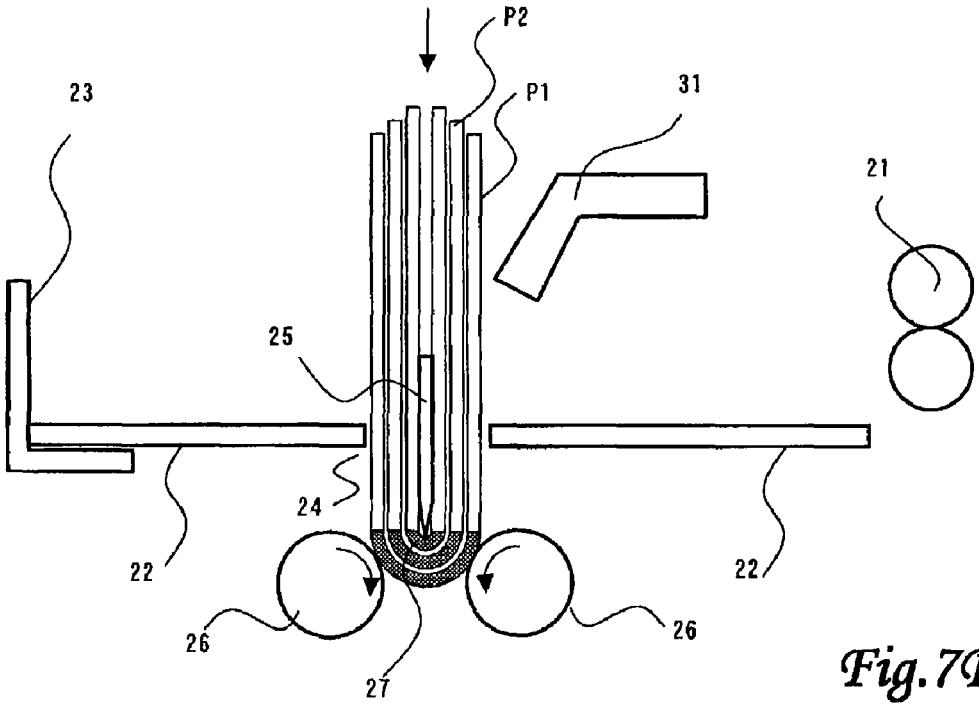
FIG. 7B is a pattern diagram for showing humidifying control of sheet according to the first embodiment of the present invention.

As shown in FIGS. 7A and 7B, the humidifying width may be variably controlled for each sheet composing the booklet.

As shown in FIG. 7A, the humidifying width is controlled so that a humidifying width X2 of a sheet P2 on the inner position of the booklet is smaller than a humidifying width X1 of a sheet P1 on the outer position. The humidifying width may be changed for each sheet in such a manner.

With this constitution, as shown in FIG. 7B, when the fold lines of the book let are formed by the folding roller pair 26, the humidifying width can be set to the proper amount according to a folding region of each sheet composing the booklet.

As a result, the sheet with a small folding region on the inner position of the booklet is prevented from being excessively humidified, and the sheet with a large folding region on the outer position of the booklet is prevented from being insufficiently humidified.

That is to say, the portions to be the fold lines of the booklet can be humidified securely without waste, and thus the good-looking booklet with less opening amount can be bound.

As shown in FIGS. 8A, 8B, 9A, and 9B, the humidifying width of one sheet may be controlled variably along a portion to be the fold line of the booklet.

Figure 8A:
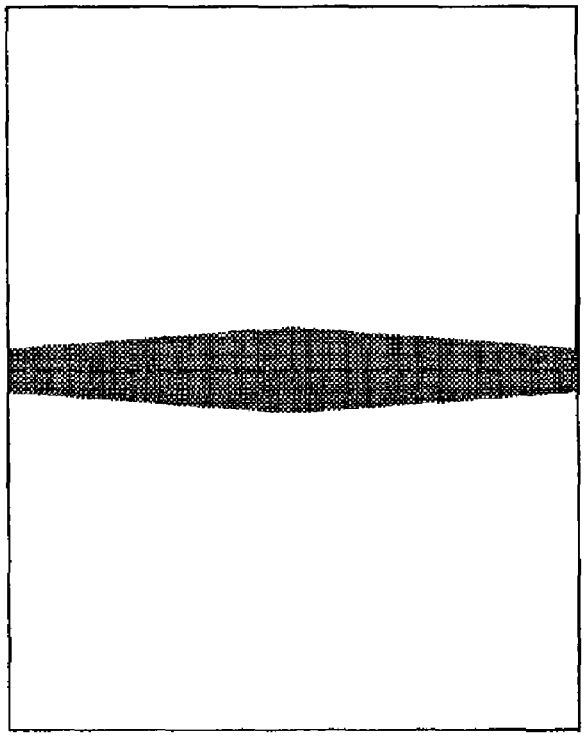
FIG. 8A is a pattern diagram for showing humidifying control of sheet according to the first embodiment of the present invention.

FIG. 8A shows a humidifying pattern when the humidifying width is controlled so that the humidifying width on a center portion of the sheet becomes larger than end portions of the sheet.

When the number of sheets is large and the fold lines are formed on a thick booklet, the folding roller pair 26 is easily deflected. A pressurizing force of the folding roller pair 26 on the center portions of the sheets is occasionally weakened due to the deflection. As a result, the center portions of the sheets cannot be securely folded, and thus a poor-looking booklet where opening occurs might be provided.

As shown in FIG. 8A, however, when the humidifying width is controlled so that the humidifying width of the center portion of the sheet becomes large, the rigidity of the sheet can be decreased on positions closer to the center portion of the sheet. The fold line can be securely formed on the center portion of the sheet even by a weak pressure.

Therefore, even when the pressurizing force of the folding roller pair 26 to be applied to the center portion of the sheet is weakened, the sheet can be securely folded. For this reason, a good-looking booklet with less opening can be bound.

Figure 8B:
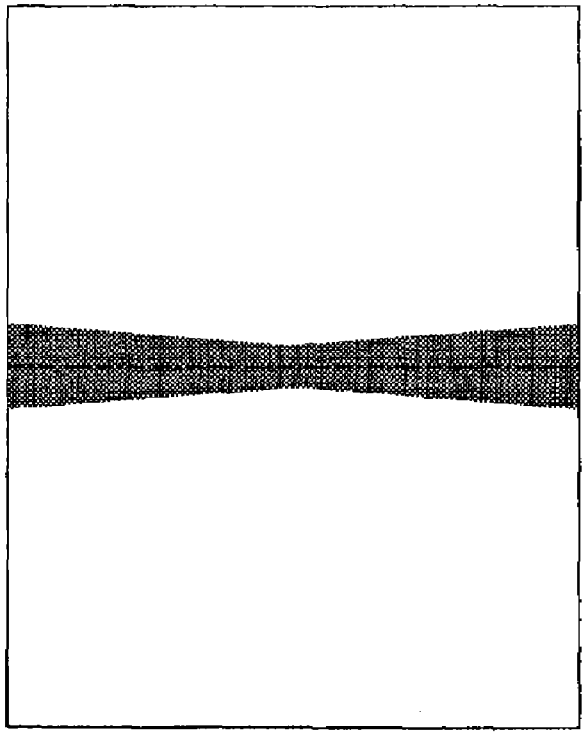
FIG. 8B is a pattern diagram for showing humidifying control of sheet according to the first embodiment of the present invention.

FIG. 8B shows a humidifying pattern when the humidifying width is controlled so that the humidifying width on the center portion of the sheet becomes smaller than the end portions of the sheet.

In the case where sheets where moisture is easily evaporated from the end portions of the sheets are used, at the time when the booklet is folded by the folding roller pair 26, the end portions of the sheets could be dried. As a result, the end portions of the sheets are in an insufficiently humidified state, and it is difficult to securely form the fold line, thereby providing a poor-looking booklet where opening occurs.

As shown in FIG. 8B, however, when the humidifying width is controlled so that the humidifying width on the end portions of the sheet becomes larger than that on the center portion, even if moisture is evaporated from the end portions of the sheet, the end portions is unlikely to be in the insufficiently humidified state.

Since the portion of sheet to be the fold line of the booklet from the center portion to the end portions is securely humidified, the fold line can be formed securely on the booklet. As a result, the good-looking booklet with less opening can be bound.

Figure 9A:
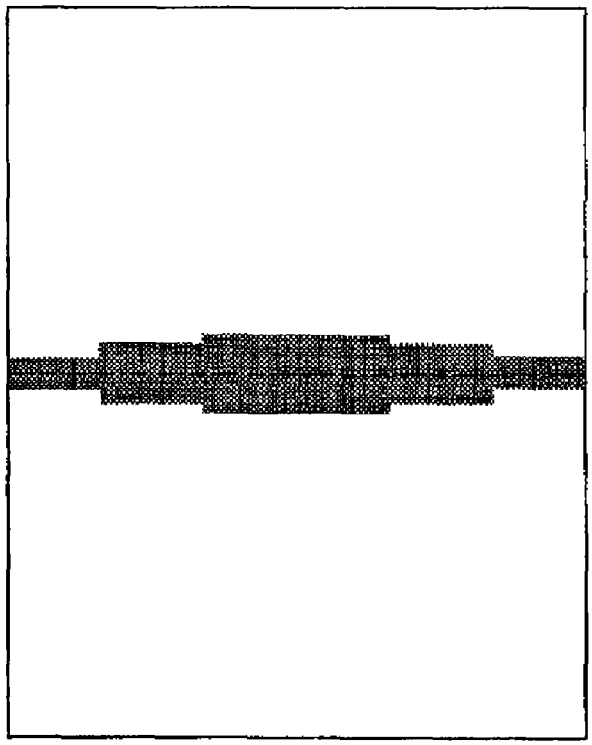
FIG. 9A is a pattern diagram for showing humidifying control of sheet according to the first embodiment of the present invention.
Figure 9B:
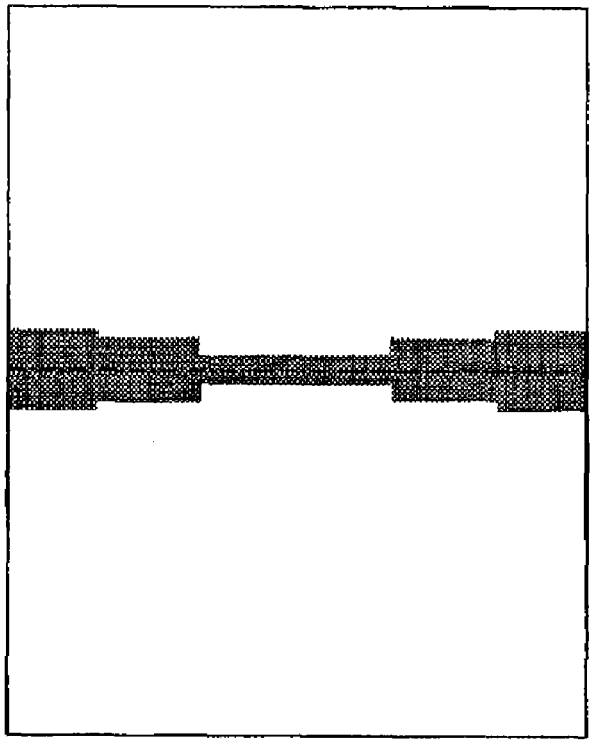
FIG. 9B is a pattern diagram for showing humidifying control of sheet according to the first embodiment of the present invention.

In FIGS. 8A and 8B, the humidifying width of the sheet in the direction along the portion of the booklet to be folded is controlled variably and sequentially. The humidifying control of the present invention is not limited to this, and as shown in FIGS. 9A and 9B, it goes without saying that a constitution such that the humidifying width is controlled variably in a stepwise fashion can produce the similar effect.

The humidifying control in the first embodiment is made based on information relating to the opening amount of sheets as mentioned above. The information relating to the opening amount of the sheets includes, for example, the rigidity of sheets, the number of sheets composing a booklet, and the fiber orientation of sheets.

As to these pieces of information, the rigidity of sheets, the number of sheets composing a booklet, and the fiber orientation of sheets may be detected directly by the detecting portion provided to the image forming apparatus main body 1 or the bookbinding apparatus 2. In another manner, they may be input in advance by a user by the operation panel 152. As a result, the humidifying is carried out effectively according to the opening amount of sheets, so that a good-looking booklet without opening can be bound.

Second Embodiment

The bookbinding apparatus and the image forming apparatus having the bookbinding apparatus according to a second embodiment of the present invention are described with reference to FIGS. 5A, 5B, 10A, and 10B.

In the first embodiment, the humidifying width on the portions of a booklet to be folded is variably controlled. In the second embodiment, however, the humidifying amount on the portion of a booklet to be folded is controlled variably.

Since (The Constitution of the Image Forming Apparatus Main Body), (The Constitution of the Bookbinding Apparatus), (The Constitution of the Humidifying Unit), and (The Constitution of the Stacking Unit) in the second embodiment are identical to those in the first embodiment, the description thereof will not be described. Only (The Constitution of the Humidifying Control) which is the characteristic of the second embodiment is described.

(Constitution of the Humidifying Control)

The constitution of the humidifying control in the second embodiment is described with reference to FIGS. 5A, 5B, 10A, and 10B.

In the second embodiment of the present invention, a controller is disposed. When the humidifying nozzle 31 as the humidifying unit humidifies portions of sheets to be fold lines of a booklet, the controller variably controls the humidifying amount.

Figure 5A:
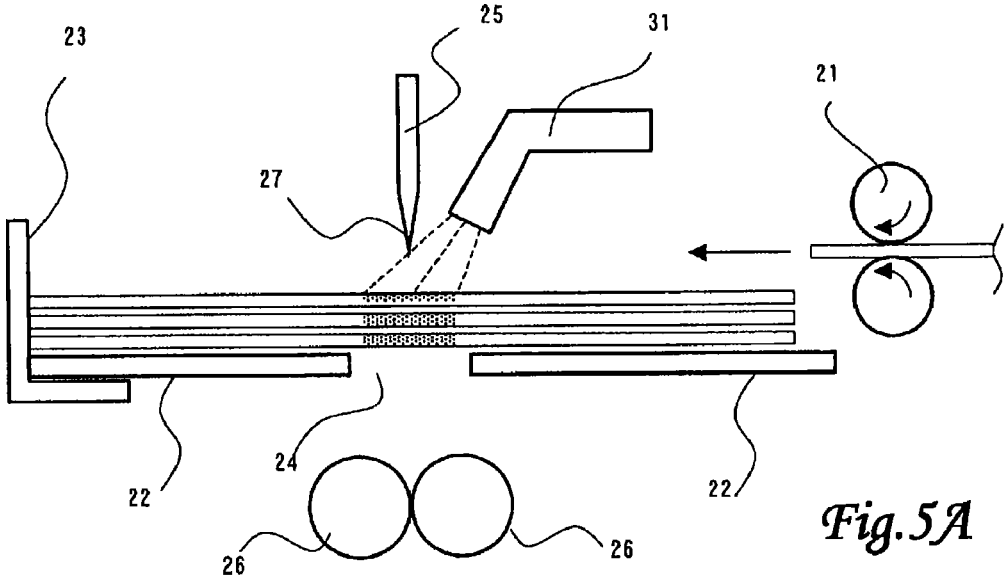
FIG. 5A is a pattern diagram for showing humidifying control of sheet according to the second embodiment of the present invention.

When sheets whose opening amount is not much large are used, as shown in FIG. 5A, even if the humidifying amount on portions to be the fold lines of the booklet is set to a small value, the opening amount of the sheets can be sufficiently reduced.

Figure 5B:
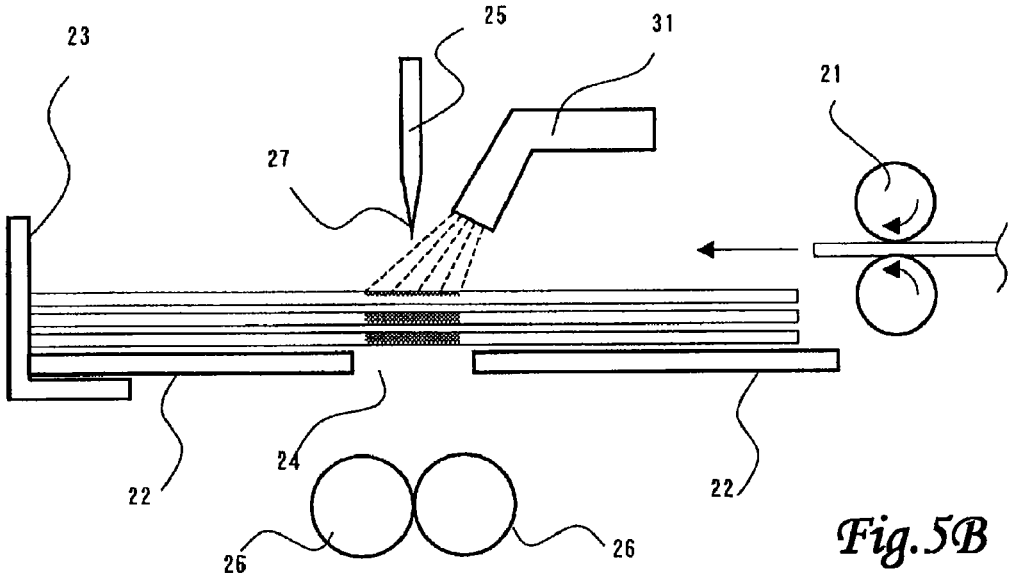
FIG. 5B is a pattern diagram for showing humidifying control of sheet according to the second embodiment of the present invention.

When sheets with large opening amount are used, it is necessary for sufficiently reducing the opening amount of the sheets to increase the humidifying amount on the portions to be the fold lines of the booklet as shown in FIG. 5B.

When the humidifying amount is controlled so as to be larger as the opening amount of the sheets is larger, even if a booklet is bound by using sheets with large opening amount, the sheets can be securely folded and a good-looking booklet without opening can be obtained.

The humidifying amount may be controlled variably for each sheet composing a booklet. When a thick sheet is used for a cover of a booklet, the humidifying amount is increased, and the humidifying amount of the sheets on the inner side is decreased, so that satisfactory fold lines can be formed.

The humidifying amount is made to be larger for sheets on the inner side of the booklet, and the humidifying amount is made to be smaller for sheets on the outer side, so that satisfactory fold lines can be formed.

That is to say, since the moisture moves from the inside to the outside and is evaporated from the surface of the outmost sheet, accordingly the humidifying amount is controlled so that the entire booklet can be uniformly humidified.

Figure 10A:
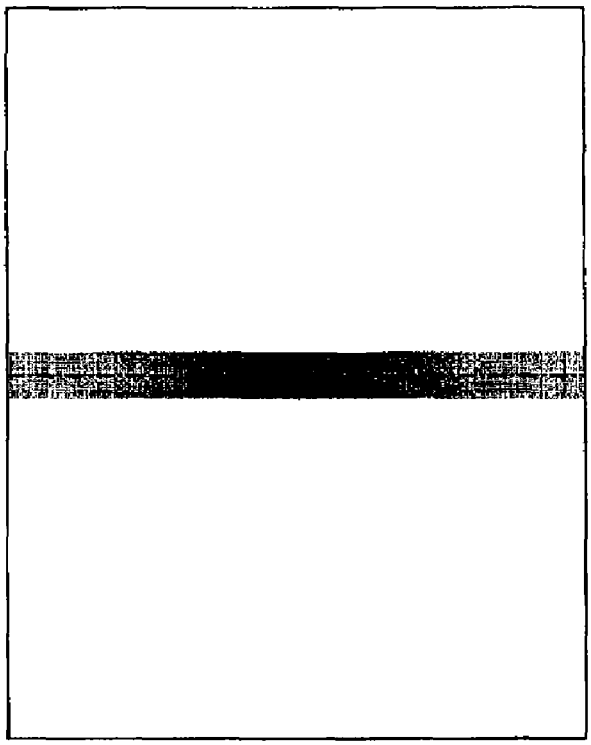
FIG. 10A is a pattern diagram for showing humidifying control of sheet according to the second embodiment of the present invention.
Figure 10B:
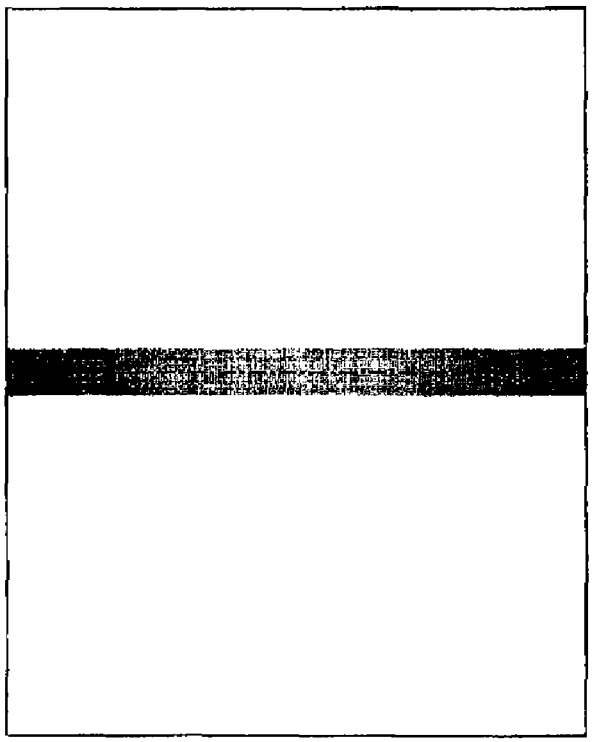
FIG. 10B is a pattern diagram for showing humidifying control of sheet according to the second embodiment of the present invention.

As shown in FIGS. 10A and 10B, the humidifying amount may be controlled variably along a portion of one sheet to be a fold line of a booklet.

FIG. 10A shows a humidifying pattern when the humidifying amount is controlled so that the humidifying amount on the center portion of the sheets is larger than that on the end portions of the sheets.

When the number of the sheets is large and a fold line is formed for a thick booklet, the folding roller pair 26 is easily deflected, and the pressurizing force of the folding roller pair 26 on the center portion of the sheets is occasionally weakened due to the deflection. As a result, the center portions of the sheets cannot be folded, and thus a poor-looking booklet where the opening occurs might be obtained.

As shown in FIG. 10A, when the humidifying amount is controlled so as to be larger on the center portion of the sheets, the rigidity of the sheets can be reduced on positions closer to the center portion of the sheets. Therefore, the fold line can be formed securely on the center portions of the sheets even by the weak pressure.

Even when the pressurizing force of the folding roller pair 26 on the center portion of the sheets is weakened, the sheets can be folded securely. As a result, a good-looking booklet with less opening can be bound.

FIG. 10B shows a humidifying pattern when the humidifying amount is controlled so that the humidifying amount on the center portion of the sheet becomes smaller than that on the end portions of the sheet.

When a sheet where moisture is easily evaporated from the end portions of the sheet is used, at the time when a fold line is formed on a booklet by the folding roller pair 26, the end portions of the sheet might be dried. As a result, the end portions of the sheet are in the insufficiently humidified state, and it is difficult to form a fold line securely, and thus a poor-looking booklet where opening occurs might be obtained.

As shown in FIG. 10B, when the humidifying amount is controlled so that the humidifying amount on the end portions of the sheet becomes larger than that on the center portion, even if moisture is evaporated from the end portions of the sheet, the end portions are less likely to be in the insufficiently humidified state.

Since the portions of the sheets to be the fold lines of a booklet from the center portions to the end portions are humidified securely, the fold lines cab be formed securely on the booklet. As a result, the good-looking booklet with less opening can be bound.

The humidifying control in the second embodiment is made based on the information relating to the opening amount of the sheet as mentioned above. The information relating to the opening amount of the sheet includes the rigidity of sheets, the number of sheets composing a booklet, the fiber orientation of sheets, for example.

These pieces of information may be detected by the detecting portion provided to the image forming apparatus main body 1 or the bookbinding apparatus 2, or may be input in advance by a user by the operation panel 152. As a result, the effective humidifying is carried out according to the opening amount of the sheets so that a good-looking booklet without opening can be bound.

Third Embodiment

The bookbinding apparatus and the image forming apparatus having the bookbinding apparatus according to a third embodiment of the present invention are described with reference to FIGS. 6A, 6B, and 12.

In the first embodiment, the humidifying width on the portion of the sheet to be a fold line of a booklet is controlled variably. In the second embodiment, the humidifying amount on the portion of the sheet to be a fold line of a booklet is controlled variably.

On the contrary, in the third embodiment of the present invention, a control is selectively made whether to humidify portions of sheets to be fold lines of a booklet.

Since (The Constitution of the Image Forming Apparatus Main Body), (The Constitution of the Bookbinding Apparatus), (The Constitution of the Humidifying Units), and (The Constitution of the Stacking Unit) are identical to those in the first and second embodiments, the description thereof will not be described. Only (The Constitution of the Humidifying Control) which is the characteristic of the third embodiment is described.

(The Constitution of the Humidifying Control)

The humidifying control in the third embodiment is described with reference to FIGS. 6A, 6B, and 12.

In the third embodiment, the humidifying nozzle 31 as the humidifying unit has a controller which selectively switches whether to humidify portions of sheets to be the fold lines of a booklet.

Figure 6A:
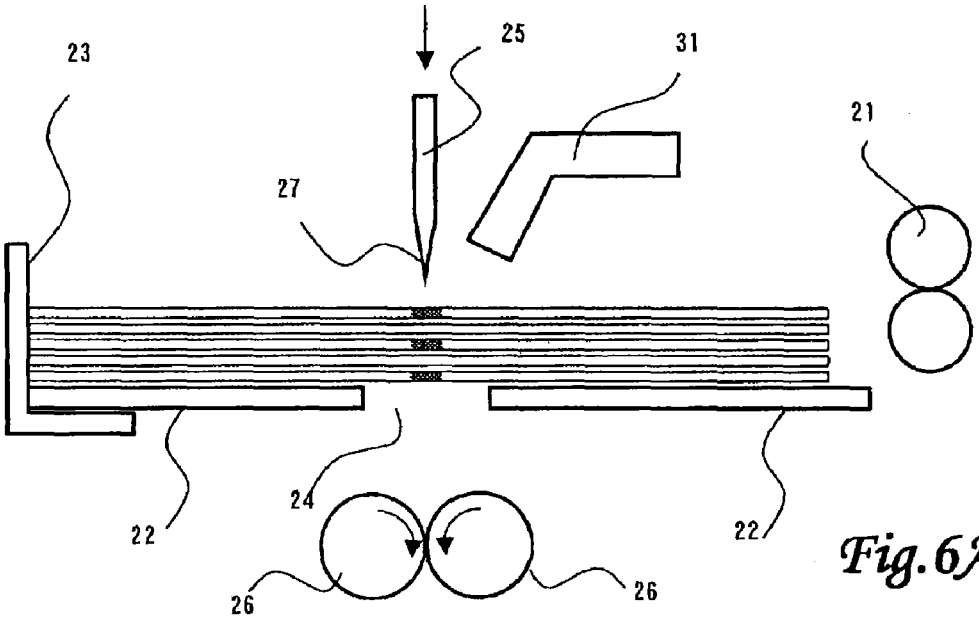
FIG. 6A is a pattern diagram for showing humidifying control of sheet according to the third embodiment of the present invention.

When the opening amount of the sheets composing a booklet is not much large and all the sheets composing the booklet do not have to be humidified, as shown in FIG. 6A, every other sheets composing the booklet or every few sheets may be humidified.

When sheets composing a booklet which are humidified and thus their opening amount should be reduced and sheets which do not have to be humidified are mixed, only the sheets which require humidifying are humidified, and the other sheets are not humidified.

When the control is made whether to humidify every sheet composing the booklet according to the opening amount of the sheetsood-looking booklet with less opening can be bound efficiently without excessive humidifying or insufficient humidifying.

Figure 6B:
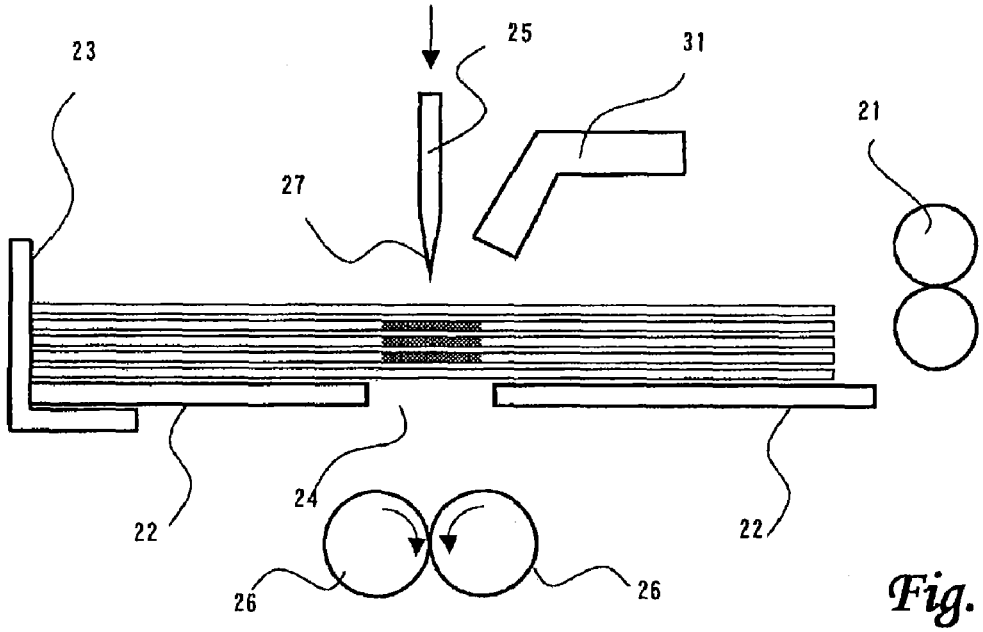
FIG. 6B is a pattern diagram for showing humidifying control of sheet according to the third embodiment of the present invention.

As shown in FIG. 6B, the control may be made so that only the sheets on the innermost position of the booklet and the sheet on the outermost position are not humidified, and the sheets sandwiched therebetween are humidified.

Such a control constitution is suitable for the case where special sheets, in which minute wrinkle, wave, and color change occur on the surface due to humidifying, such as coated paper whose surface is subject to special coating and Japanese paper whose fiber is coarse, are used for an appearance surface of a booklet.

With such a control constitution, since a sheet to be the appearance surface of a booklet is not humidified, minute wrinkle, wave, and color change do not occur on the surface of the sheet to be the appearance surface. For this reason, the visual quality of a booklet is not deteriorated.

Since the portions of the sheets on the inner side of the booklet to be the fold lines are humidified, the opening amount of the sheets can be securely reduced. With such a control constitution, therefore, a good-looking booklet with less opening can be bound.

Figure 12:
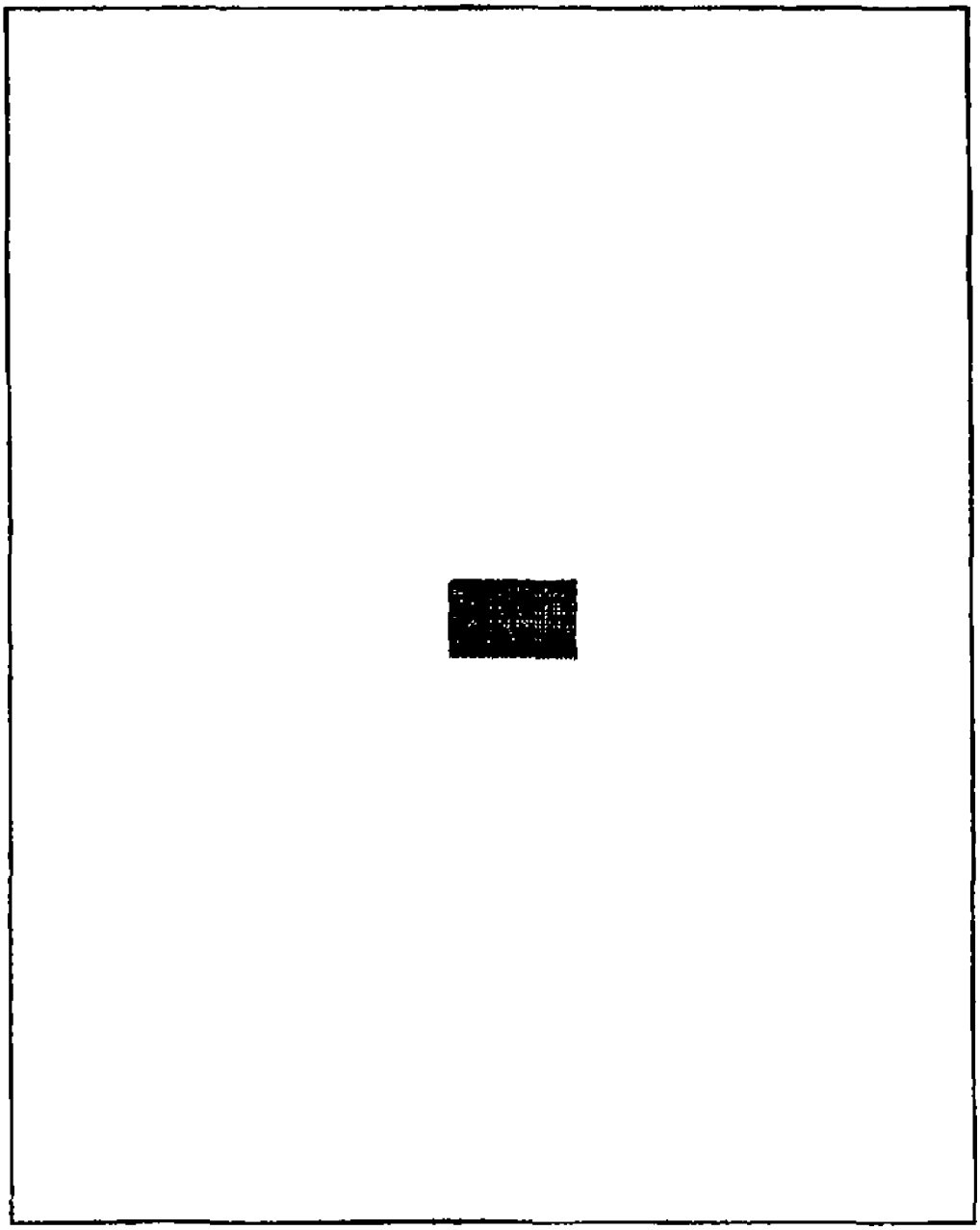
FIG. 12 is a pattern diagram for showing humidifying control of sheet according to the third embodiment of the present invention.

As shown in FIG. 12, the control may be selectively made whether to humidify a portion of one sheet to be a fold line of a booklet.

FIG. 12 shows a humidifying pattern when a control is made whether to humidify a portion to be a fold line of a booklet and only a center portion of the sheet is humidified.

Even in the case of sheets whose opening amount is so small that the humidifying does not have to be carried out, when the number of the sheets is large, a booklet becomes thick. When such a booklet with large thickness is nipped by the folding roller pair 26 so as to be folded, the folding roller pair 26 is deflected, and the pressurizing force against the center portion of the booklet is weakened due to deflection.

When the pressurizing force of the folding roller pair 26 is weakened, it is difficult to form a fold line securely, and thus a poor-looking booklet with opening might be obtained.

As shown in FIG. 12, however, when the center portion of the sheet where the pressurizing force is weakened is humidified, even if the pressurizing force of the folding roller pair 26 is weakened, the center portion of the sheet can be securely folded.

Therefore, since the portion of the sheet to be the fold line of a booklet can be securely folded, a good-looking booklet with less opening can be bound.

The humidifying control in the third embodiment is made based on the information relating to the opening amount of sheets as mentioned above. The information relating to the opening amount of the sheets includes, for example, the rigidity of sheets, the number of sheets composing a booklet, and a fiber orientation of sheets.

These pieces of information may be detected by the detecting portion provided to the image forming apparatus main body 1 or the bookbinding apparatus 2, or may be input in advance by a user by the operation panel 152. As a result, the humidifying is carried out effectively according to the opening amount of sheets, and thus a good-looking booklet without opening can be bound.

Fourth Embodiment

The bookbinding apparatus and the image forming apparatus having the bookbinding apparatus according to a fourth embodiment of the present invention are described with reference to FIGS. 11A and 11B.

In the first embodiment, the humidifying width on the portions of sheets to be the fold lines of a booklet is controlled variably. In the second embodiment, the humidifying amount on the portions of sheets to be the fold lines of a booklet is controlled variably. In the third embodiment, a control is selectively made whether to humidify portions of sheets to be the fold lines of a booklet.

On the contrary, in the fourth embodiment of the present invention, humidifying control is made as to a combination of whether to humidify the portions of sheets to be the fold lines of a booklet and the humidifying width.

Since (The Constitution of the Image Forming Apparatus Main Body), (The Constitution of the Bookbinding Apparatus), (The Constitution of the Humidifying Units), and (The Constitution of the Stacking Unit) are identical to those in the first, second, and third embodiments, the description thereof will not be described. Only (The Constitution of the Humidifying Control) which is the characteristic of the fourth embodiment is described.

(The Constitution of the Humidifying Control)

The humidifying control in the fourth embodiment is described with reference to FIGS. 11A and 11B.

In the fourth embodiment of the present invention, the humidifying nozzle 31 as the humidifying unit has a controller which makes a control as to the combination of whether to humidify the portions of sheets to be the fold lines of a booklet and the humidifying width.

Figure 11A:
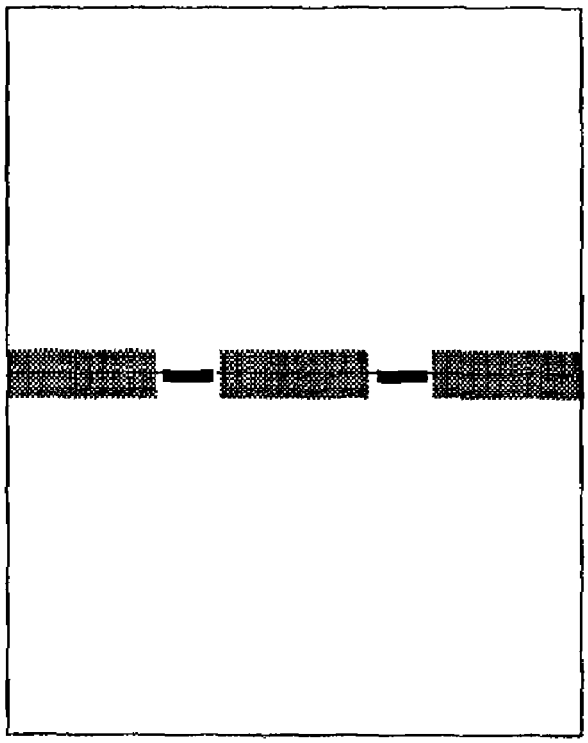
FIG. 11A is a pattern diagram for showing humidifying control of sheet according to the fourth embodiment of the present invention.

FIG. 11A shows a humidifying pattern when a region except for a portion of one sheet which a binding tool (stapler) 27 pierces is partially humidified at the time of binding a booklet using the binding tool 27.

Since strength is deteriorated on the portion of the sheet humidified by the humidifying nozzle 31, when the binding tool 27 pierces the humidified portion, that portion might rip.

In this case, the control is made whether to humidify and the humidifying width so that the portion which the binding tool 27 does not pierce in the portion to be the fold line of a booklet is humidified. As a result, a good-looking booklet with less opening can be obtained without ripping of the sheets due to the binding process.

Figure 11B:
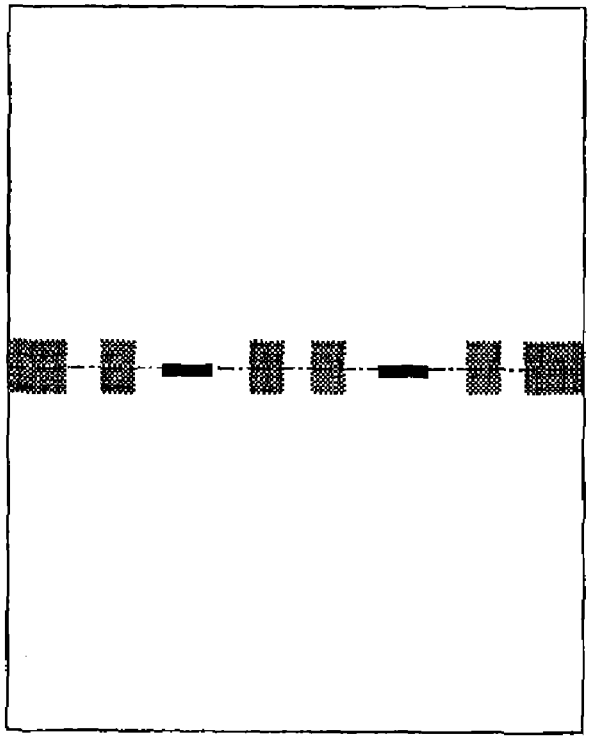
FIG. 11B is a pattern diagram for showing humidifying control of sheet according to the fourth embodiment of the present invention.

FIG. 11B shows a humidifying pattern when a region which does not contact with a folding knife 25 in a sheet to be humidified is partially humidified.

Figure 15:
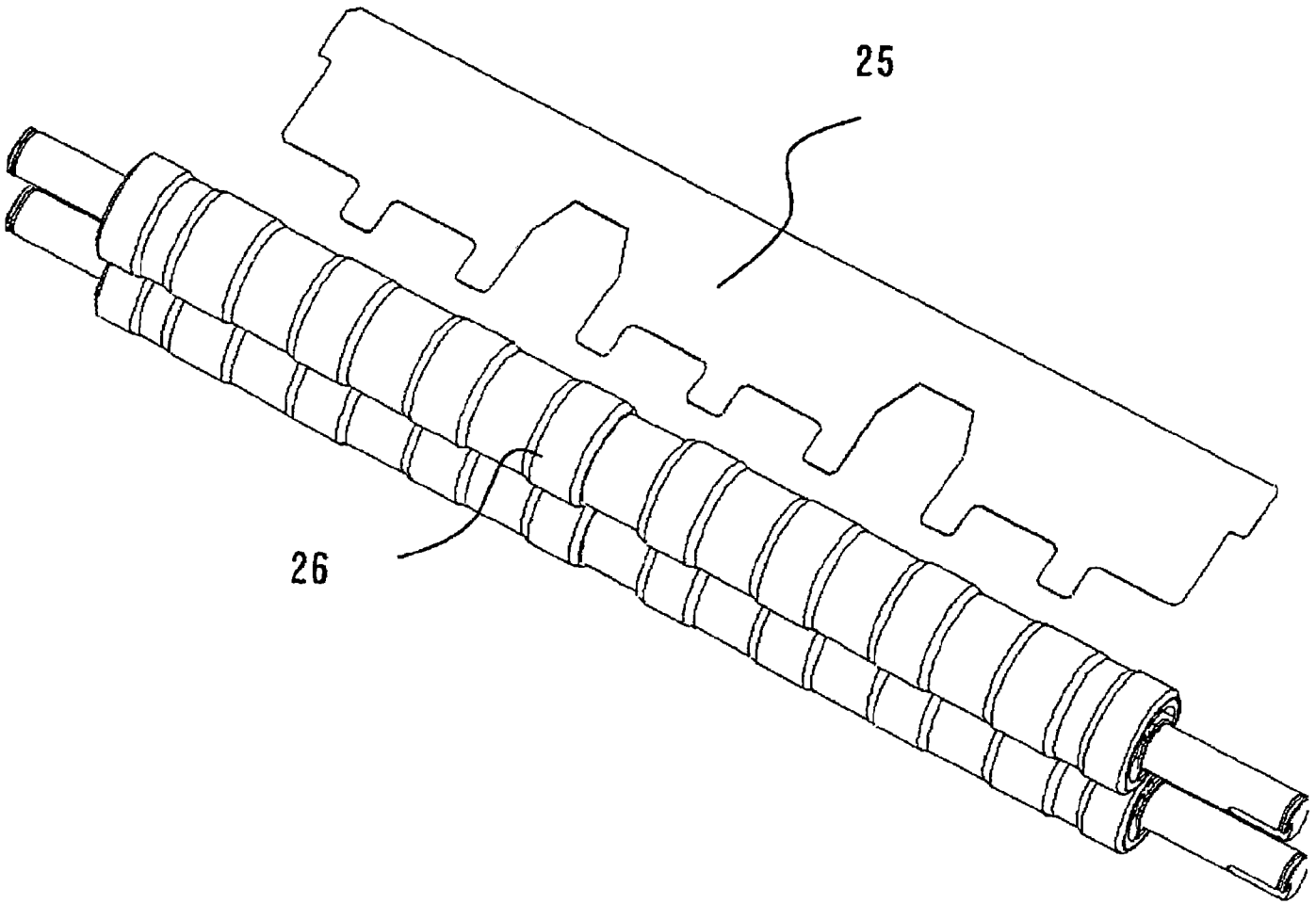
FIG. 15 is the oblique perspective drawing of a folding knife and a folding roller pair according to the present invention.
Figure 16:
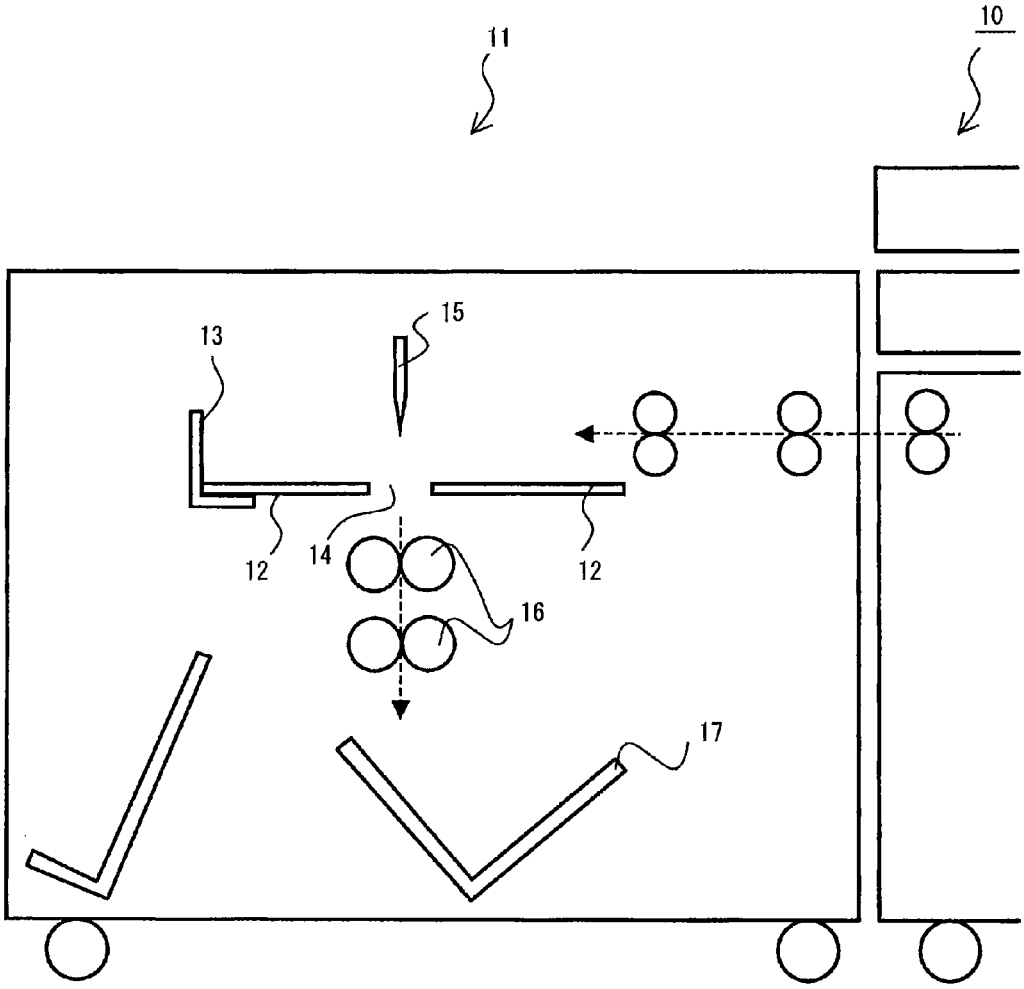
FIG. 16 is a schematic block diagram of a bookbinding device and an image forming apparatus main body according to the prior art.
Figure 17:
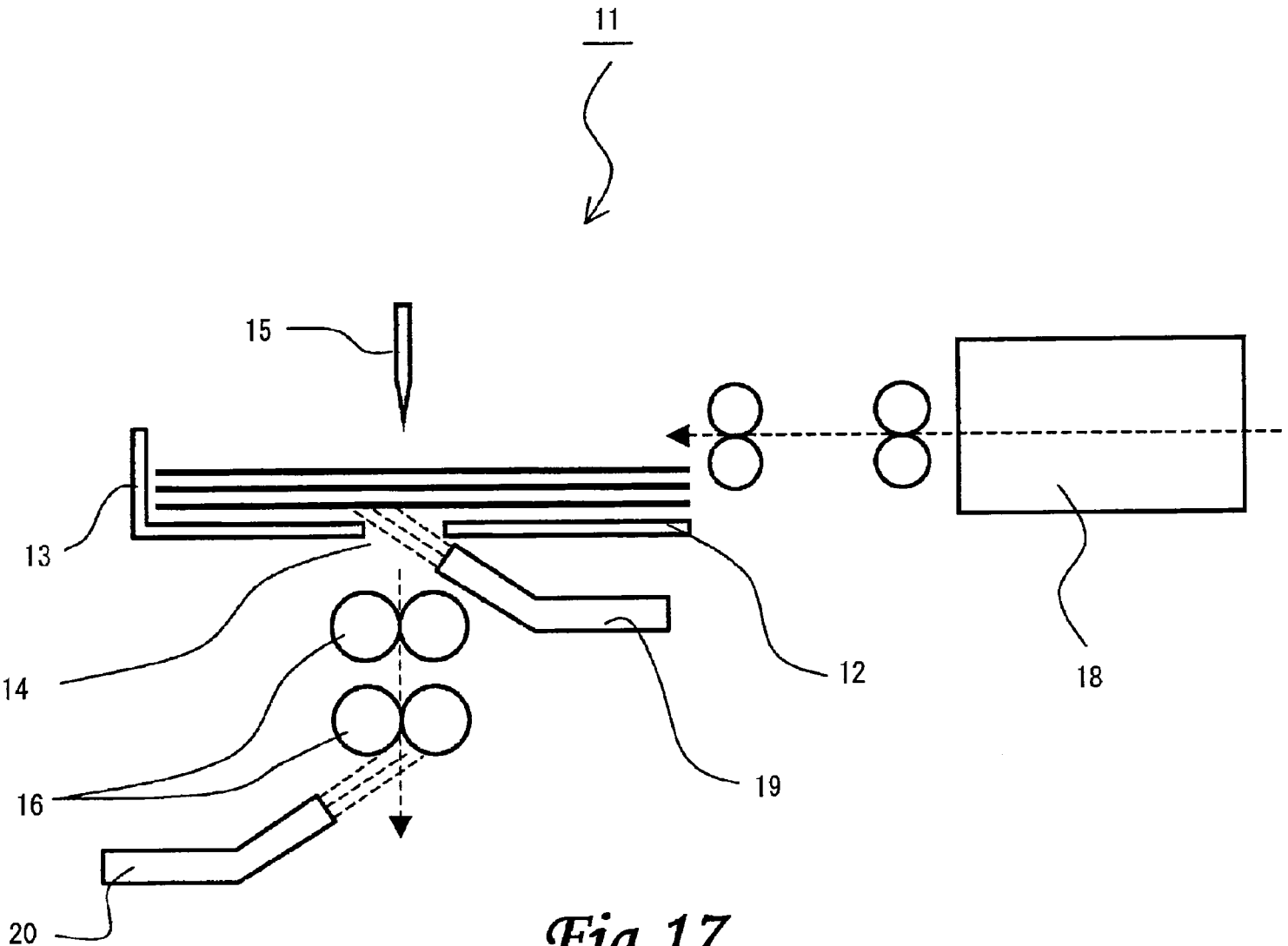
FIG. 17 is a schematic block diagram of a bookbinding device according to the prior art.

The folding knife 25 may have an approximately straight shape having a uniform cross section on an entire area along the fold line formed on a sheet. On the other hand, as shown in FIG. 15, the folding roller pair 26 and the folding knife 25 have a stepped shape, and they may be arranged into comb-teeth like pattern.

As a result, when the folding knife 25 is descended and the booklet is pushed into a nip of the folding roller pair 26 or the folding knife 25 is again ascended so as to be separated, load resistance and sliding resistance can be reduced.

When the portion of the sheet which contacts with the folding knife 25 is humidified, the strength of the sheet is insufficient on the portion to be humidified. For this reason, the sheet might starts to rip on the contact range of the folding knife 25.

In this case, as shown in FIG. 11B, the range which contacts with the folding knife 25 is not partially humidified, so that the folding knife 25 can be allowed to contact or separate with/from the contact portion while the strength of the sheet is being maintained.

The control may be made as to the combination of whether to humidify the portion to be a fold line and the humidifying width so that the portion which does not contact with the folding knife 25 is humidified.

According to this humidifying control, the ripping of the sheets due to the contact of the folding knife 25 is prevented, and thus a good-looking booklet with less opening can be provided.

The humidifying control in the fourth embodiment is made based on the information relating to the opening amount of sheets as mentioned above. The information relating to the opening amount of the sheets includes the rigidity of sheets, the number of sheets composing a booklet, and a fiber orientation of sheets.

These pieces of information may be detected by the detecting portion provided to the image forming apparatus main body 1 or the bookbinding apparatus 2, or may be input in advance by a user by the operation panel 152. As a result, the humidifying is carried out effectively according to the opening amount of sheets, and thus a good-looking booklet without opening can be bound.

Fifth Embodiment

The bookbinding apparatus and the image forming apparatus having the bookbinding apparatus according to a fifth embodiment of the present invention are described with reference to FIGS. 13A and 13B.

In the fourth embodiment, a control is made as to a combination of whether to humidify the portions of sheets to be the fold lines of a booklet and the humidifying width. On the contrary, in the fifth embodiment of the present invention, a control is made as to a combination of whether to humidify the portions of sheets to be the fold lines of a booklet and the humidifying amount.

Since (The Constitution of the Image Forming Apparatus Main Body), (The Constitution of the Bookbinding Apparatus), (The Constitution of the Humidifying Units), and (The Constitution of the Stacking Unit) are identical to those in the first, second, third and fourth embodiments, the description thereof will not be described. Only (The Constitution of the Humidifying Control) which is the characteristic of the fifth embodiment is described.

(The Constitution of the Humidifying Control)

The Constitution of the humidifying control of the humidifying unit in the fifth embodiment is described with reference to FIGS. 13A and 13B.

In the fifth embodiment of the present invention, the humidifying nozzle 31 as the humidifying unit has a controller which makes a control as to the combination of whether to humidify the portions of sheets to be the fold lines of a booklet and the humidifying amount.

Figure 13A:
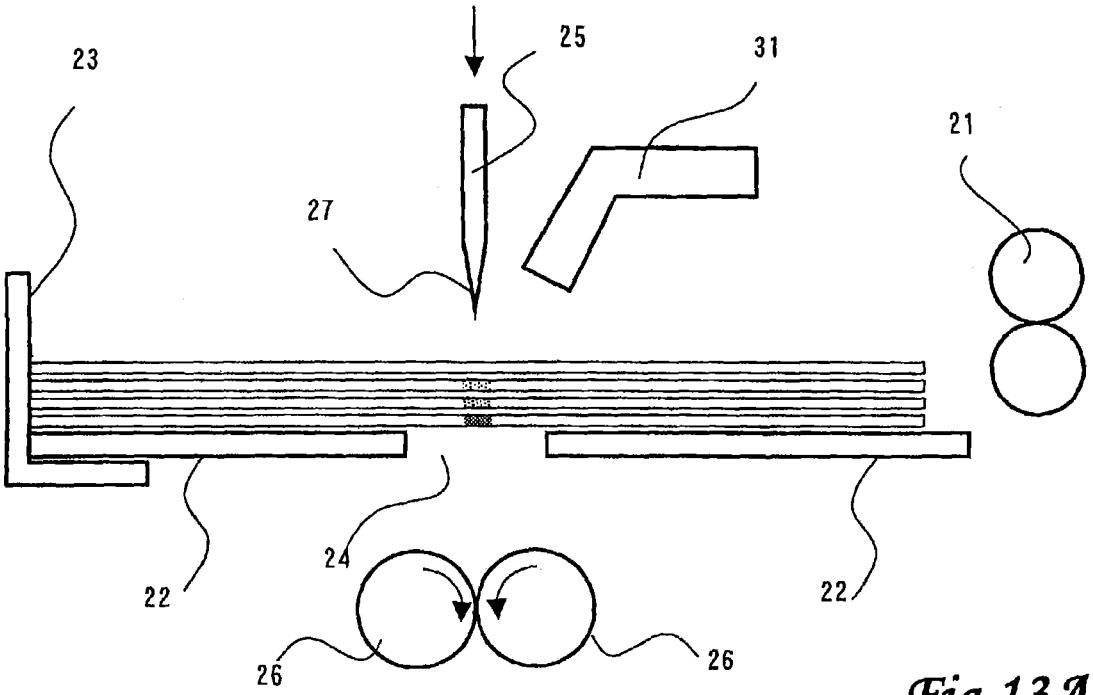
FIG. 13A is a pattern diagram for showing humidifying control of sheet according to the fifth embodiment of the present invention.

As shown in FIG. 13A, when a booklet is composed of plural types of sheets with different opening amounts, a control is made so that a sheet whose opening amount is so small that the humidifying is not necessary is not humidified. The humidifying amount may be controlled for sheets with large opening amount so as to be larger on sheets with larger opening amount according to the opening amount.

Even when a booklet is composed of plural types of sheets with different opening amounts, a control is made according to the opening amounts whether to humidify. When the humidifying is carried out, the humidifying amount is controlled, thereby effectively reducing the opening amount of sheets.

Therefore, a fold line can be formed on a booklet securely, and thus the good-looking booklet without opening can be bound.

Figure 13B:
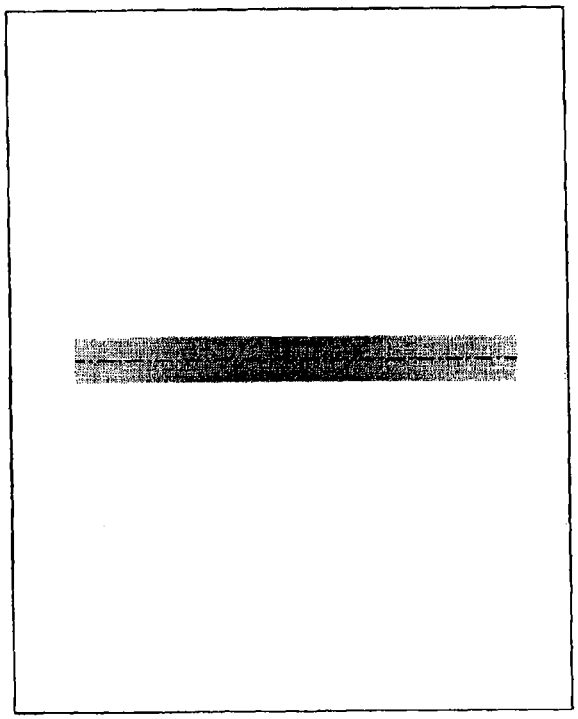
FIG. 13B is a pattern diagram for showing humidifying control of sheet according to the fifth embodiment of the present invention.

As shown in FIG. 13B, a control whether to humidify and the variable control of the humidifying amount may be made along a portion of one sheet to be a fold line of a booklet.

FIG. 13B shows a humidifying pattern when the end portions of sheets are not humidified, but portions other than the end portions are humidified along portions to be fold lines of a booklet, and the humidifying amount is controlled to become larger on positions closer to the center portion of sheets.

Even when sheets whose opening amount is so small that the humidifying does not have to be carried out are used, if the number of sheets is large, a thick booklet is obtained. When the thick booklet is nipped by the folding roller pair 26, the folding roller pair 26 is occasionally deflected.

When the folding roller pair 26 is deflected, the pressurizing force of the folding roller pair 26 against the center portion of the booklet might be weakened. As a result, the center portion of the booklet cannot be securely folded, and thus the poor-looking booklet with opening might be obtained.

As shown in FIG. 13B, however, when the humidifying amount is set so as to be large on the center portion of the sheet where the pressurizing force is weakened, even if the pressurizing force of the folding roller pair 26 is weakened, the center portion of the sheet can be securely folded. Since the end portions of the sheet are securely pressurized by the folding roller pair 26, the humidifying is not necessary. Therefore, unnecessary humidifying is not carried out, and thus this case is efficient.

According to the humidifying control, since the opening amount of the sheets can be reduced, a good-looking booklet with less opening can be bound.

The humidifying control in the fifth embodiment is made based on the information relating to the opening amount of sheets as mentioned above. The information relating to the opening amount of the sheets includes the rigidity of sheets, the number of sheets composing a booklet and a fiber orientation of sheets.

These pieces of information may be detected by the detecting portion provided to the image forming apparatus main body 1 or the bookbinding apparatus 2, or may be input in advance by a user by the operation panel 152. As a result, the humidifying is carried out effectively according to the opening amount of sheets, and thus a good-looking booklet without opening can be bound.

Sixth Embodiment

The bookbinding apparatus and the image forming apparatus having the bookbinding apparatus according to a sixth embodiment of the present invention are described with reference to FIG. 14.

In the fourth embodiment, a control is made as to the combination of whether to humidify the portions of sheets to be fold lines of a booklet and the humidifying width. In the fifth embodiment of the present invention, a control is made as to the combination of whether to humidify the portions of sheets to be the fold lines of a booklet and the humidifying amount.

On the contrary, in the sixth embodiment of the present invention, a control is made as to the combination of the humidify amount and the humidifying width on the portions of the sheets to be fold lines of a booklet.

Since (The Constitution of the Image Forming Apparatus Main Body), (The Constitution of the Bookbinding Apparatus), (The Constitution of the Humidifying Units), and (The Constitution of the Stacking Unit) are identical to those in the first, second, third, fourth and fifth embodiments, the description thereof will not be described. Only (The Constitution of the Humidifying Control) which is the characteristic of the sixth embodiment is described.

(The Constitution of the Humidifying Control)

The Constitution of the humidifying control of the humidifying unit in the sixth embodiment is described with reference to FIG. 14.

In the sixth embodiment of the present invention, the humidifying nozzle 31 as the humidifying unit has a controller which makes a control as to the combination of the humidifying amount and the humidifying width on the portions of sheets to be fold lines of a booklet.

Figure 14:
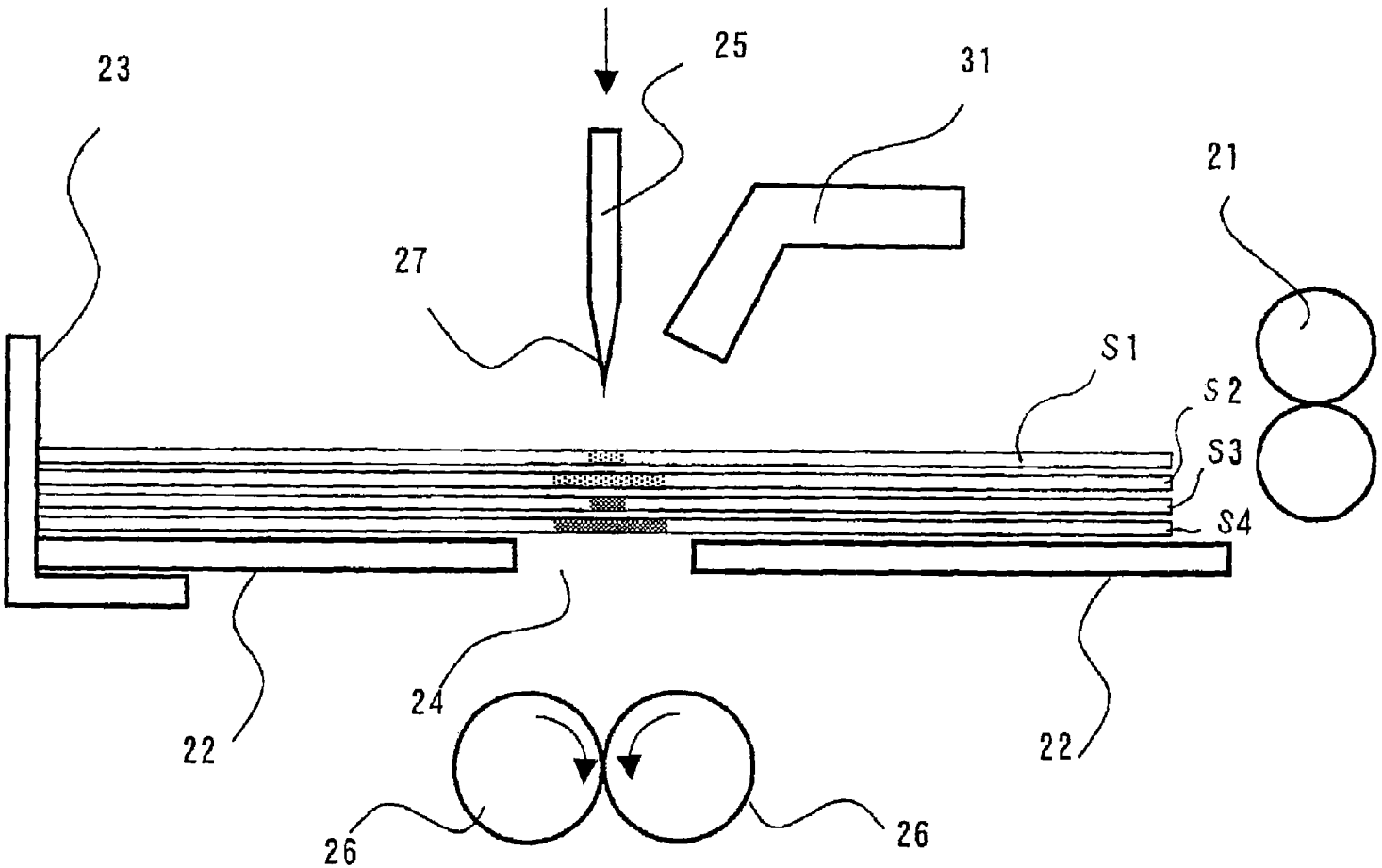
FIG. 14 is a pattern diagram for showing humidifying control of sheet according to the sixth embodiment of the present invention.

FIG. 14 shows a humidifying pattern when the humidifying width and the humidifying amount are controlled and sheets S1 to S4 composing a booklet are humidified.

As to the sheet S1 whose opening amount is not much large, the humidifying width and the humidifying amount are controlled so as to have small values, so that portions to be fold lines of a booklet may be humidified.

The sheet S2 with large opening amount might rip because its strength is deteriorated due to a large amount of humidifying when the humidifying amount is increased. As to the sheet S2, the humidifying may be controlled so that the humidifying width is made to be large without increasing the humidifying amount.

The sheet S3 with large opening amount might be poor looking because moisture is given to a portion on which an image is formed by the image forming apparatus main body 1 when the humidifying width is increased. As to the sheet S3, the humidifying may be controlled so that the humidifying amount is increased without increasing the humidifying width.

Ripping is not caused by the large amount of humidifying and moisture is not given to an image formed portion by increase in the humidifying width on the sheet S4 with particularly large opening amount. As to the sheet S4, the humidifying may be controlled so that the humidifying amount and the humidifying width increase.

When the humidifying width and the humidifying amount are controlled for each sheet composing a booklet so that portions to be fold lines of a booklet are humidified. As a result, the opening amount of the sheets composing the booklet can be reduced, and thus the good-looking booklet without opening can be bound.

The humidifying control in the sixth embodiment is made based on the information relating to the opening amount of sheets as mentioned above. The information relating to the opening amount of the sheets includes, for example, the rigidity of sheets, the number of sheets composing a booklet, and the fiber orientation of sheets.

These pieces of information may be detected by the detecting portion provided to the image forming apparatus main body 1 or the bookbinding apparatus 2, or may be input in advance by a user by the operation panel 152. As a result, the humidifying is carried out effectively according to the opening amount of sheets, and thus a good-looking booklet without opening can be bound.

The fourth to sixth embodiments describe the controller which makes a control as to the combination of any two of humidifying conditions including the humidifying width, the humidifying amount, and whether to humidify. However, it goes without saying that the similar effect can be obtained by making a control as to the combination of all these three humidifying conditions.

This application claims priority from Japanese Patent Application No. 2006-291646 filed Oct. 26, 2006, which is hereby incorporated by reference, herein.

What is claimed is:

1. A bookbinding apparatus comprising:

a stacking unit on which sheets are stacked;

a folding portion which folds a booklet made up of the sheets stacked on the stacking unit;

a humidifying unit which humidifies a portion of each sheet that is made into a fold line of the folded booklet before folding by the folding portion; and a controller which controls the humidifying unit so that a humidifying width on the portion of the sheet to be the fold line of the folded booklet is variable according to each sheet composing the booklet.

2. A bookbinding apparatus according to claim 1, wherein the controller controls the humidifying unit to humidify the portion to be the fold line of the folded booklet in each sheet stacked on the stacking unit.

3. A bookbinding apparatus according to claim 2, wherein the humidifying width is controlled so that the humidifying width of a sheet on an inner position of the folded booklet is smaller than the humidifying width of a sheet on an outer position of the folded booklet.

4. A bookbinding apparatus according to claim 1, wherein the controller controls the humidifying unit to humidify the portion of the sheet to be the fold line of the folded booklet from an inner side of the folded booklet.

5. A bookbinding apparatus according to claim 1, wherein the controller controls the humidifying unit to sequentially humidify the sheets from a sheet on an outer position of the folded booklet to a sheet on an inner position of the folded booklet.

6. A bookbinding apparatus according to claim 1, wherein the humidifying width is controlled so that the humidifying width on a center portion of the sheet becomes larger than end portions of the sheet.

7. An image forming apparatus comprising:

an image forming unit which forms an image on sheets; and a bookbinding apparatus according to claim 1 which binds the sheets on which the image is formed by the image forming unit.

8. A bookbinding apparatus comprising:

a stacking unit on which sheets are stacked;

a folding portion which folds a booklet made up of the sheets stacked on the stacking unit;

a humidifying unit which humidifies a portion of each sheet that is made into a fold line of the folded booklet before folding by the folding portion; and a controller which controls the humidifying unit so that at least two of a humidifying width on the portion of the sheet to be the fold line of the folded booklet, a humidifying amount, and whether to humidify or not is variable according to each sheet composing the booklet.

9. A bookbinding apparatus according to claim 8, wherein the controller controls the humidifying unit to humidify the portion of the sheet to be the fold line of the folded booklet in each sheet stacked on the stacking unit.

10. A bookbinding apparatus according to claim 8, wherein the controller controls the humidifying unit to humidify the portion of the sheet to be the fold line of the folded booklet from an inner side of the folded booklet.

11. A bookbinding apparatus according to claim 8, wherein the controller controls the humidifying unit to sequentially humidify the sheets from a sheet on an outer position of the folded booklet to a sheet on an inner position of the folded booklet.

12. An image forming apparatus comprising:

an image forming unit which forms an image on sheets; and a bookbinding apparatus according to claim 8 which binds the sheets on which the image is formed by the image forming unit.

13. A bookbinding apparatus comprising:

a stacking unit on which sheets are stacked;

a folding portion which folds a booklet made up of the sheets stacked on the stacking unit;

a humidifying unit which humidifies a portion of each sheet that is made into a fold line of the folded booklet before folding by the folding portion; and a controller which controls the humidifying unit so that a humidifying condition is variable according to each sheet composing the booklet, wherein the sheets are sequentially stacked on the stacking unit so that surfaces of the sheets stacked on the stacking unit humidified by the humidifying unit face up.

14. An image forming apparatus comprising:

an image forming unit which forms an image on sheets; and a bookbinding apparatus according to claim 13 which binds the sheets on which the image is formed by the image forming unit.

15. A bookbinding apparatus comprising:

a stacking unit on which sheets are stacked;

a folding portion which folds a booklet made up of the sheets stacked on the stacking unit;

a humidifying unit which humidifies a portion of each sheet that is made into a fold line of the folded booklet before folding by the folding portion; and a controller which controls the humidifying unit so that a humidifying condition based on information relating to an opening amount of the sheets to be humidified is variable according to each sheet composing the booklet.

16. A bookbinding apparatus according to claim 15, wherein the controller controls the humidifying unit to humidify the portion to be the fold line of the folded booklet in each sheet stacked on the stacking unit.

17. A bookbinding apparatus according to claim 15, wherein the controller controls the humidifying unit to humidify the portion of the sheet to be the fold line of the folded booklet from an inner side of the folded booklet.

18. A bookbinding apparatus according to claim 15, wherein the controller controls the humidifying unit to sequentially humidify the sheets from a sheet on an outer position of the folded booklet to a sheet on an inner position of the folded booklet.

19. A bookbinding apparatus according to claim 15, wherein the controller controls the humidifying width to become larger as the opening amount of the sheets is larger.

20. A bookbinding apparatus according to claim 15, wherein the humidifying amount is controlled so as to be larger as the opening amount of the sheets is larger.

21. An image forming apparatus comprising:

an image forming unit which forms an image on sheets; and a bookbinding apparatus according to claim 15 which binds the sheets on which the image is formed by the image forming unit.

* * * * *